US011939870B2

(12) United States Patent
Davies

(10) Patent No.: US 11,939,870 B2
(45) Date of Patent: Mar. 26, 2024

(54) GAS-CYCLE SYSTEM FOR HEATING OR COOLING

(71) Applicant: Eric Davies, Morley (AU)

(72) Inventor: Eric Davies, Morley (AU)

( * ) Notice: Subject to any disclaimer, the term of this patent is extended or adjusted under 35 U.S.C. 154(b) by 0 days.

(21) Appl. No.: 17/633,442

(22) PCT Filed: Aug. 10, 2020

(86) PCT No.: PCT/AU2020/050828

§ 371 (c)(1),
(2) Date: Feb. 7, 2022

(87) PCT Pub. No.: WO2021/026599

PCT Pub. Date: Feb. 18, 2021

(65) Prior Publication Data

US 2022/0282623 A1 Sep. 8, 2022

(30) Foreign Application Priority Data

Aug. 9, 2019 (AU) ..... 2019902853

(51) Int. Cl.
*F01C 11/00* (2006.01)
*F01C 1/10* (2006.01)
(Continued)

(52) U.S. Cl.
CPC ..... *F01C 11/004* (2013.01); *F01C 13/04* (2013.01); *F01C 21/06* (2013.01); *F01C 21/18* (2013.01); *F01C 1/103* (2013.01)

(58) Field of Classification Search
CPC ..... F01C 11/004; F01C 13/04; F01C 21/06; F01C 21/18; F01C 1/103
See application file for complete search history.

(56) References Cited

U.S. PATENT DOCUMENTS 4,138,848 A 2/1979 Bates
5,732,560 A * 3/1998 Thuresson ..... F25B 9/004 62/402

(Continued)

FOREIGN PATENT DOCUMENTS

WO 2003067030 A2 8/2003
WO 2005073513 A2 8/2005
WO 2007037599 A2 4/2007

*Primary Examiner* — J. Todd Newton

(57) ABSTRACT

A gas-cycle system operable using a Bell-Coleman cycle, the gas-cycle system comprising an expander (23) and a compressor (27) incorporated in a flow path (13). The expander (23) and compressor (27) are integrated in a rotary machine (41), and each comprises a rotor assembly (70) configured to define one or more zones (80) each of which changes continuously in volume during a rotation cycle of the rotor assembly. The expander (23) and compressor (27) are drivingly interconnected whereby rotational drive applied to one is transmitted directly to the other. Each rotor assembly (70) comprises an inner rotor (73) and an outer rotor (75) adapted to rotate about parallel axes at different rotational speeds. The inner rotors (73) are each drivingly connected to a common shaft for rotation therewith. The two outer rotors (75) are coupled together such that rotational drive applied to one is transmitted directly to the other. An air-cycle system and an air conditioning system (10) based on the gas-cycle system are also disclosed.

17 Claims, 13 Drawing Sheets

(51) Int. Cl.

| | |
|---|---|
| ***F01C 13/04*** | (2006.01) |
| ***F01C 21/06*** | (2006.01) |
| ***F01C 21/18*** | (2006.01) |

(56) References Cited

U.S. PATENT DOCUMENTS

| | | | | |
|---|---|---|---|---|
| 2007/0186578 | A1 | 8/2007 | Lee | |
| 2018/0347362 | A1* | 12/2018 | Holtzapple | F01C 21/08 |

* cited by examiner

GAS-CYCLE SYSTEM FOR HEATING OR COOLING

CROSS-REFERENCE TO RELATED APPLICATIONS

This application is an U.S. national phase application under 35 U.S.C. § 371 based upon International Application No. PCT/AU2020/050828 filed on Aug. 10, 2020. Additionally, this U.S. national phase application claims the benefit of priority of International Application No. PCT/AU2020/050828 filed on Aug. 10, 2020 and Australia Application No. 2019902853 filed on Aug. 9, 2019. The entire disclosures of the prior applications are incorporated herein by reference. The international application was published on Feb. 18, 2021 under Publication No. WO 2021/026599 A1.

TECHNICAL FIELD

This invention relates to a gas-cycle system using a Bell-Coleman cycle.

BACKGROUND ART

The following discussion of the background art is intended to facilitate an understanding of the present invention only. The discussion is not an acknowledgement or admission that any of the material referred to is or was part of the common general knowledge as at the priority date of the application.

The invention is particularly applicable as an air-conditioning system for both heating and cooling. Accordingly, it will be convenient to hereinafter disclose the invention in relation to that exemplary application. However, it is to be appreciated that the invention is not limited to that application and may be used in other applications requiring heating and/or cooling of a gaseous fluid. By way of example, the invention may be applicable as an air-cycle system configured for heating ambient air or an air-cycle system configured for cooling ambient air. Further, the invention may find application in industrial and chemical processing fields as a gas-cycle system configured for heating a gas or a gas-cycle system configured for cooling a gas Typically, the air conditioning of living spaces and other environments requires a very heavy use of energy, which is expensive and often environmentally damaging. Typically, cooling is accomplished using a conventional refrigeration cycle and heating is accomplished using either a reverse refrigeration cycle or by applying heat directly from an outside source such as an electric element or burning fuel.

In heating, reverse refrigeration systems are more energy efficient than heat supplied from an outside source because, instead of generating heat outright, they upgrade the temperature of existing heat, sourced from the external environment. However, because of inefficiencies in the refrigeration cycle, the typical coefficient of performance (COP—the ratio between heat produced and energy consumed) of such systems is limited to approximately 5.5.

In cooling, refrigeration systems have COP limited to approximately 4.5, because of inefficiencies in the refrigeration cycle.

Conventional refrigeration cycles have an inherent inefficiency which is impossible to circumvent. Considerable energy must be expended to compress the refrigerant and that energy is lost, as heat, in the cooling part of the cycle. Thermodynamically, cooling is achieved by converting the internal energy of the refrigerant into kinetic energy. Any attempt to recover that energy would result in the loss of the refrigeration effect.

In traditional air conditioning systems ventilation is expensive because it necessitates removing air that has already been heated or cooled and replacing it with outside air which must then be heated or cooled to the appropriate temperature.

Currently, inverters are used in electrically driven air conditioning systems to reduce power consumption when a high level of performance is not required, such as when an air-conditioned space reaches target temperature. The use of inverters comes with significant energy cost because of inherent inefficiencies in inverters.

In the past the Bell-Coleman cycle has been used for cooling, primarily for refrigeration. This cycle uses air as the refrigerant, which leads to numerous negative outcomes, including:

a) Machinery is typically large and cumbersome, which is inconvenient and expensive. This is necessary because thermodynamic processes are limited to sensible heat (i.e. heat that can be detected by a thermometer), whereas conventional refrigeration utilises latent heat. A large volume of air is therefore required to produce effective refrigeration. The large size also leads to high levels of friction.

b) In the Bell-Coleman cycle air is often cooled to below freezing within the working space of the machinery and this is problematic because snow is formed and accumulates around valves, restricting air flow.

c) Reciprocating components of significant mass cause vibration.

The Bell-Coleman cycle is currently used in the air conditioning of aircraft but that is viable because of the proximity of large jet engines, from which compressed air can be tapped.

The COP of the Bell-Coleman cycle varies considerably depending on environmental conditions and in the past adjustments to optimise the COP in various conditions have not been built into machinery.

It is against this background that the present invention has been developed. In particular, the present invention seeks to provide an air conditioning system that is more energy efficient than currently employed systems and optionally incorporates provision for the introduction of fresh air without significant cost, or to at least provide an air conditioning system that offers a useful choice when considered with respect to currently employed systems.

SUMMARY OF INVENTION

According to a first aspect of the invention there is provided a gas-cycle system operable using a Bell-Coleman cycle, the gas-cycle system comprising an expander and a compressor, the expander and compressor each comprising a rotor assembly configured to define a zone which changes continuously in volume during a rotation cycle of the rotor assembly, the expander and compressor being drivingly interconnected whereby rotational drive applied to one is transmitted directly to the other.

In the context of the present invention, reference to the expander and compressor being drivingly interconnected whereby rotational drive applied to one is transmitted directly to the other is intended to mean that rotational drive is transmitted without invoking frictional losses in such transmission. In other words, the transmission of rotational drive is direct and without any loss of energy due to friction.

In practical terms, this may be by way of a direct connection for transmission of rotational drive between the expander and compressor; that is, a connection without any intervening mechanism (such as for example an intervening drive transmission mechanism or an intervening gear mechanism) which would invoke frictional losses.

Each rotor assembly may comprise an inner rotor and an outer rotor adapted to rotate about parallel axes at different rotational speeds. The inner and outer rotors may be configured to define the zone which changes continuously in volume during a rotation cycle of the rotor assembly. Typically, the inner and outer rotors define a plurality of said zones which are in circumferentially spaced relation and each of which changes continuously in volume during a rotation cycle of the rotor assembly.

Each inner rotor may comprise an externally-lobed rotor and the counterpart outer rotor may comprise an internally-lobed rotor, wherein the externally-lobed inner rotor is rotatable inside the internally-lobed outer rotor. With this arrangement, the zones defined between the inner and outer rotors comprise inter-lobe zones.

Each inner rotor may comprise a plurality of external lobes. In a preferred arrangement, the inner rotor comprises two external lobes in diametrally opposed relation.

Each outer rotor may comprise a plurality of internal lobes in circumferentially spaced relation. In a preferred arrangement, the outer rotor comprises three internal lobes.

Each outer rotor may comprise at least one port for communicating with the zone defined within the respective rotor assembly. The port may be located between two adjacent internal lobes.

There may be a plurality of the ports for communicating with a plurality of zone defined within the respective rotor assembly. The ports may be located between adjacent internal lobes.

In the case in which the inner rotor comprises two external lobes in diametrally opposed relation and the outer rotor comprises three internal lobes in circumferentially spaced relation, the inner and outer rotors cooperate to define three of said zones. With this arrangement, there are three of the ports provided between adjacent internal lobes on the outer rotor respectively to communicate with the three zones.

The external lobes of the inner rotor and the internal lobes of the outer rotor may be of an epicyclic configuration.

The inner rotors may each be drivingly connected to a common shaft for rotation therewith. The common shaft may comprise a drive shaft for the expander and compressor.

One outer rotor may be drivingly connected to the shaft through a drive transmission. The drive transmission may comprise a gear assembly comprising an external gear and an internal gear. In one arrangement, the external gear is mounted on the drive shaft and the internal gear is connected to the outer rotor. With this arrangement, rotational drive applied to the inner rotor through the common shaft is transmitted to the outer rotor through the drive transmission.

The two outer rotors may be coupled together such that rotational drive applied to one is transmitted directly to the other.

The drive shaft may be caused to rotate in any appropriate way; for example, rotational torque may be applied to the drive shaft by way of a drive motor such as an electric motor.

Each rotor assembly may be accommodated within a housing having an inlet and an outlet. The housing may define a cavity in which the rotor assembly is received, wherein the ports of the internally-lobed outer rotor move sequentially into and out of registration with the inlet and outlet upon rotation of the rotor assembly within the housing.

Each zone defined between the inner rotor and the outer rotor is nominally sealed after the respective port communicating with the zone moves out of registration with the inlet and prior to the respective port moving into registration with the outlet, with the zone continuously changing in volume between the inlet and the outlet as the rotor assembly rotates.

In the case of the expander, the volume of the zone continuously increases between the inlet and the outlet as the rotor assembly rotates.

In the case of the compressor, the volume of the zone continuously decreases between the inlet and the outlet as the rotor assembly rotates.

The expander may further comprise means for selectively varying the timing of registration of the port or ports in the outer rotor thereof with the inlet of the expander.

The compressor may further comprise means for selectively varying the timing of registration of the port or ports in the outer rotor thereof with the outlet of the compressor.

Variations of the timing of registration of the respective port or ports with the inlet of the expander and the timing of registration of the respective port or ports with the outlet of the compressor effectively varies the degree of expansion and compression.

The variation of timing of registration of the respective ports with the inlet of the expander and the outlet of the compressor may be achieved by respectively varying the extent of registration in the direction of angular movement of the respective ports. This may be provided by varying the size of the inlet of the expander and the size of the outlet of the compressor. For instance, the distance between opposed ends of the expander inlet (with reference to the direction of angular movement of the respective ports) may be selectively variable, thereby varying the extent of registration between the port or ports and the inlet as the port(s) sweeps past the inlet during rotation of the rotor assembly of the expander. More particularly, the expander inlet may be selectively variable to adjust the point at which the respective port(s) moves out of registration with the inlet. Similarly, the distance between opposed ends of the compressor outlet (with reference to the direction of angular movement of the respective ports) may be selectively variable, thereby varying the extent of registration between the port or ports and the outlet as the port(s) sweeps past the outlet during rotation of the rotor assembly of the compressor. More particularly, the compressor outlet may be selectively variable to adjust the point at which the respective port(s) moves into registration with the outlet.

There may be provision for selectively varying the ratio of the volume of the zone or zones in the expander and the volume of the zone or zones in the compressor.

One or both of the rotor assemblies may be provided with means for selectively varying the swept volume (i.e. the maximum available volume condition) of each zone defined between the inner rotor and the outer rotor, thereby enabling the selective variation of the ratio of the expansion and compression volumes. By way of example, this variation may be achieved by movement of a boundary surface of the zone to effect a variation of the volume of the zone. For instance, there may be provided a selectively movable element which defines a boundary surface of the zone, with movement of the element causing a change in the volume of the zone.

The expander and compressor may be integrated in a rotary machine. With such an arrangement, the machine may incorporate two rotor assemblies on a common drive shaft, one rotor assembly corresponding to the expander and the other corresponding to the compressor. The common drive shaft may comprises the shaft to which the inner rotors are drivingly connected for rotation therewith.

As discussed above, each rotor assembly may comprise an externally-lobed inner rotor and an internally-lobed outer rotor, whereby the externally-lobed inner rotor is rotatable inside the internally-lobed outer rotor. Such a rotary machine may be much smaller than machines of the past; the swept volume being 60% of the operating volume of the machine compared with a reciprocating machine with a typical swept volume of less than 10%. Other applications of the Bell-Coleman cycle require the use of turbines which cause loss of energy due to friction.

Further, there are no valves to be blocked by snow. The air passages are open ports, which enables unrestricted air flow, resulting in low air flow friction.

Still further, there are no touching surfaces in the operational area of the rotary machine, which greatly reduces the running friction.

Still further, there are no reciprocating masses in the rotary machine, which greatly reduces vibration.

The gas-cycle system may be selectively operable to perform a heating cycle or a cooling cycle. In such circumstances, the Bell-Coleman cycle is used for both heating and cooling.

In the heating cycle, incoming gas to be heated is expanded adiabatically, thereby reducing the pressure and temperature. The gas is then passed through a heat exchanger and warmed, typically to a temperature at or approaching that of a heat source, without changing the pressure. The gas is then compressed adiabatically to ambient pressure, which increases the temperature, and then discharged.

In the cooling cycle, incoming gas to be cooled is compressed adiabatically, thereby increasing the pressure and temperature. The gas is then passed through a heat exchanger which reduces the temperature, typically to a temperature at or approaching that of a heat sink without changing the pressure. The air is then expanded adiabatically to ambient pressure, which reduces the temperature, and then discharged.

The gas-cycle system may further comprise a pump to produce an appropriate pressure in the heat exchangers and ductwork at start-up. The pump may be controlled by a microprocessor.

According to a second aspect of the invention there is provided a gas-cycle system operable using a Bell-Coleman cycle, the gas-cycle system comprising an expander and a compressor, the expander and compressor each comprising a rotor assembly configured to define a zone which changes continuously in volume during a rotation cycle of the rotor assembly, and a port communicating with said zone, wherein the respective port moves sequentially into and out of registration with an inlet and an outlet upon rotation of the respective rotor assembly, and wherein means are provided for selectively varying the timing of registration of the respective port in the expander rotor assembly with the inlet of the expander and the timing of registration of the respective port in the compressor rotor assembly with the outlet of the compressor.

Variations of the timing of registration of the respective port with the inlet of the expander and the timing of registration of the respective port with the outlet of the compressor effectively varies the degree of expansion and compression.

The expander and compressor may be drivingly interconnected whereby rotational drive applied to one is transmitted directly to the other.

The gas-cycle system according to the second aspect of the invention may, as appropriate, have any one or more of the features specified above in relation to the first aspect of the invention.

According to a third aspect of the invention there is provided an air-cycle system comprising a gas-cycle system according to the first or second aspect of the invention.

According to a fourth aspect of the invention there is provided an air-conditioning system comprising an air-cycle system according to the third aspect of the invention.

The air-conditioning system may be selectively operable to perform a heating cycle or a cooling cycle. In such circumstances, the Bell-Coleman cycle is used for both heating and cooling.

In the heating cycle, air is drawn from a space to be heated and expanded adiabatically, thereby reducing the pressure and temperature. The air is then passed through a heat exchanger and warmed, typically to a temperature at or approaching that of a heat source, without changing the pressure. The air is then compressed adiabatically to atmospheric pressure, which increases the temperature, and then passed back to the space to be heated.

In the cooling cycle, air is drawn from a space to be cooled and compressed adiabatically, thereby increasing the pressure and temperature. The air is then passed through a heat exchanger which reduces the temperature, typically to a temperature at or approaching that of a heat sink without changing the pressure. The air is then expanded adiabatically to atmospheric pressure, which reduces the temperature, and then passed back to the space to be cooled.

The space to be heated or cooled as the case may be, may comprise a single zone or a plurality of interconnected zones.

As mentioned above, each rotor assembly may be provided with means for selectively varying the swept volume of the zone defined between the inner rotor and the outer rotor. In this way, the relative volume of the compression and expansion zones can be selectively varied. Further, the degree of expansion and compression can be varied. This, together with the option to vary relative volumes of the compression and expansion zones, enables a user to choose the preferred level of performance in the trade-off between COP and the temperature of heated/cooled air. The variables are built into the rotary machine which can be adjusted to maximise efficiency under varying environmental conditions and user preferences. The variables may be controlled by microprocessor.

As alluded to above, the air-conditioning system may further comprise a heat exchanger which will hereinafter be referred to as the principal heat exchanger.

The air-conditioning system may further comprise provision to introduce fresh air into the system. This may be achieved for no significant energy cost. Fresh air may be introduced into the flow before it enters the principal heat exchanger, with a corresponding amount of air removed as the flow exits the principle heat exchanger. In the heating cycle, energy harvested from the inflow may be used to assist in extracting air from the outflow. In the cooling cycle, energy harvested from the outflow may be used to assist in introducing air to the inflow.

The air-conditioning system may further comprise a second heat exchanger. The second heat exchanger may be employed to maximise efficiency when the temperature of the space nears target. The air, drawn in from the air-conditioned space, may exchange heat with air exiting the principal heat exchanger, before it enters the rotary machine.

The air-conditioning system may further comprise a third heat exchanger to improve COP when the space is very cold or very hot. In this configuration heat is exchanged between air incoming from the space with the heat sink or source before entering the rotary machine.

The air-conditioning system may use nearby ground or groundwater as a heat sink or heat source. This may increase the efficiency significantly compared with conventional air conditioning systems which typically rely on external air. Other forms of heat sink or heat source could of course also be used.

All processes in the function of the air-conditioning system may be controlled by a microprocessor to optimise efficiency in varying environments and user preferences.

According to a fifth aspect of the invention there is provided a gas-cycle system operable using a Bell-Coleman cycle, the gas-cycle system comprising an expander and a compressor, the expander and compressor each comprising a rotor assembly, wherein each rotor assembly comprises an externally-lobed inner rotor and a counterpart internally-lobed outer rotor, wherein the externally-lobed inner rotor is rotatable inside the internally-lobed outer rotor, and wherein the inner and outer rotors define a plurality of inter-lobe zones which change continuously in volume during a rotation cycle of the rotor assembly, wherein each rotor assembly defines a respective port communicating with each inter-lobe zone, wherein the respective port moves sequentially into and out of registration with an inlet of the expander and an outlet of the compressor upon rotation of the respective rotor assembly.

According to a sixth aspect of the invention there is provided a gas-cycle system operable using a Bell-Coleman cycle, the gas-cycle system comprising an expander and a compressor, the expander and compressor each comprising a rotor assembly configured to define a zone which changes continuously in volume during a rotation cycle of the rotor assembly, and means for selectively varying the swept volume of the zone.

According to a seventh aspect of the invention there is provided a gas-cycle system operable using a Bell-Coleman cycle, the gas-cycle system comprising an expander and a compressor, the expander and compressor being drivingly interconnected whereby rotational drive applied to one is transmitted directly to the other, the expander and compressor each comprising a rotor assembly configured to define a zone which changes continuously in volume during a rotation cycle of the rotor assembly, and means for selectively varying the ratio of the swept volume of the zones in expander and the compressor.

According to an eighth aspect of the invention there is provided a gas-cycle system operable using a Bell-Coleman cycle, the gas-cycle system comprising an expander and a compressor, the expander and compressor each comprising a rotor assembly configured to define a zone which changes continuously in volume during a rotation cycle of the rotor assembly and a port communicating with said zone, wherein the respective port moves sequentially into and out of registration with an inlet and an outlet upon rotation of the respective rotor assembly, wherein means are provided for selectively varying the timing of registration of the respective port with the inlet of the expander and the outlet of the compressor, and wherein means are provided for selectively varying the swept volume of the zone in the expander or the compressor.

According to a ninth aspect of the invention there is provided a gas-cycle system operable using a Bell-Coleman cycle, the gas-cycle system comprising an expander and a compressor, the expander and compressor being drivingly interconnected whereby rotational drive applied to one is transmitted directly to the other, the expander and compressor each comprising a rotor assembly configured to define a zone which changes continuously in volume during a rotation cycle of the rotor assembly and a port communicating with said zone, wherein the respective port moves sequentially into and out of registration with an inlet and an outlet upon rotation of the respective rotor assembly, wherein means are provided for selectively varying the timing of registration of the respective port in the expander rotor assembly with the inlet of the expander and the timing of registration of the respective port in the compressor rotor assembly with the outlet of the compressor, and means are provided for selectively varying the swept volume of the zone in the expander or the compressor.

The gas-cycle system according to any one of the fifth to ninth aspects of the invention may, as appropriate, have any one or more of the features specified above in relation to the first aspect of the invention.

According to a tenth aspect of the invention there is provided an air-conditioning system comprising a gas-cycle system according to any one of the fifth to ninth aspects of the invention.

According to a further aspect of the invention there is provided a method of operating a gas-cycle system according to any one of the preceding aspects of the invention to perform a heating cycle, wherein incoming gas to be heated is expanded adiabatically to reduce the pressure and temperature, passed through a heat exchanger and warmed without changing the pressure, compressed adiabatically to ambient pressure to increase the temperature, and then discharged.

According to a still further aspect of the invention there is provided a method of operating a gas-cycle system according to any one of the preceding aspects of the invention to perform a cooling cycle, wherein incoming gas to be cooled is compressed adiabatically to increase the pressure and temperature, passed through a heat exchanger to reduce the temperature without changing the pressure, expanded adiabatically to ambient pressure to reduce the temperature, and then discharged According to a still further aspect of the invention there is provided a method of operating the air-conditioning system according to the fourth or tenth aspect of the invention, wherein processes are controlled by a microprocessor to optimise efficiency in varying environments and user preferences.

The microprocessor may be operable to determine the size of the inlet of the expander having regard to the inlet temperature and user preferences and then establish the size of the outlet of the compressor and the relative volumes of the expansion and compression chambers.

BRIEF DESCRIPTION OF THE DRAWINGS

Further features of the present invention are more fully described in the following description of a non-limiting embodiment thereof. This description is included solely for the purposes of exemplifying the present invention. It should not be understood as a restriction on the broad summary, disclosure or description of the invention as set out above. The description will be made with reference to the accompanying drawings in which.

Figure 1:
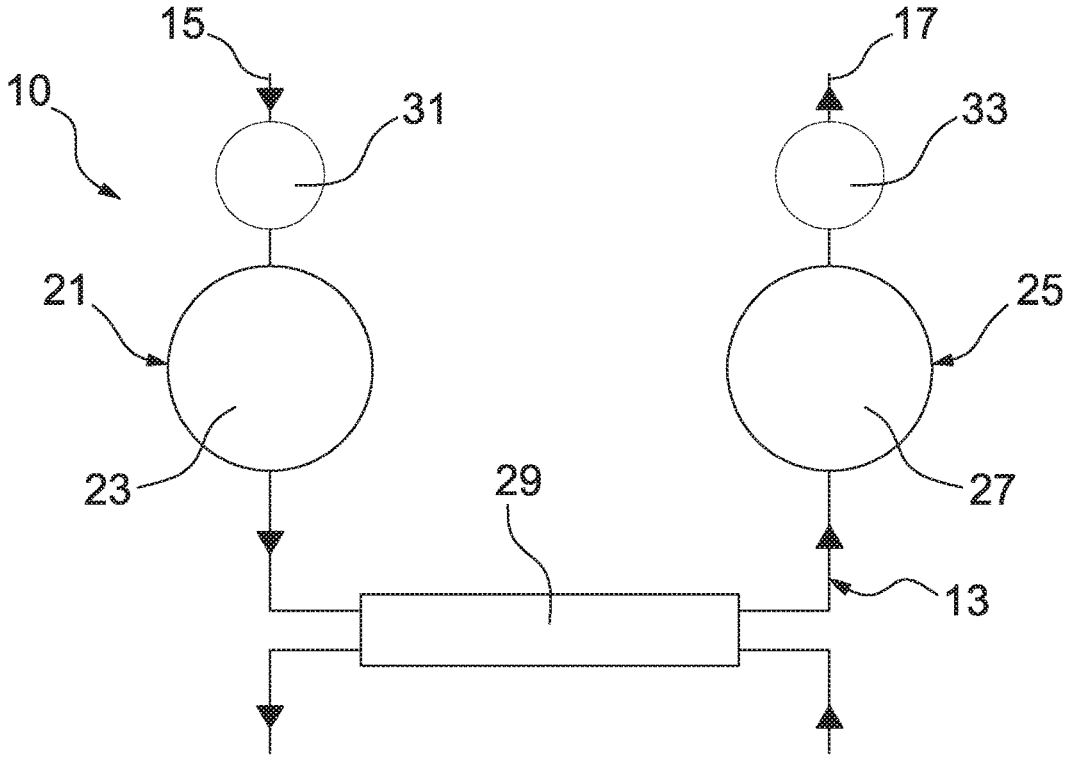
FIG. 1 is a schematic view of an embodiment of an air-conditioning system according to the invention configured for operation in a heating mode.

In the drawings like structures are referred to by like numerals throughout the several views. The drawings shown are not necessarily to scale, with emphasis instead generally being placed upon illustrating the principles of the present invention The figures depict an embodiment of the invention. The embodiment illustrate certain configurations; however, it is to be appreciated that the invention can take the form of many configurations, as would be obvious to a person skilled in the art, whilst still embodying the present invention. These configurations are to be considered within the scope of this invention

DESCRIPTION OF EMBODIMENT

In the following detailed description, the present invention is described in connection with a preferred embodiment. However, to the extent that the following description is specific to a particular embodiment or a particular use of the present techniques, it is intended to be illustrative only and merely provides a concise description of the exemplary embodiment. Accordingly, the present invention is not limited to the specific embodiment described below, but rather the invention includes all alternatives, modifications, and equivalents falling within the true scope of the appended claims.

Referring to the drawings, there is shown an embodiment of a gas-cycle system according to the invention configured as an air-conditioning system 10, which may be selectively operable to perform a heating cycle or a cooling cycle. With such an arrangement, the Bell-Coleman cycle is used for both heating and cooling.

The air-conditioning system 10 is operable for climate control of a space (not shown). The space may comprise a single zone or a plurality of interconnected zones. The space may, for example, comprise one or more rooms within a residence or other building.

Figure 2:
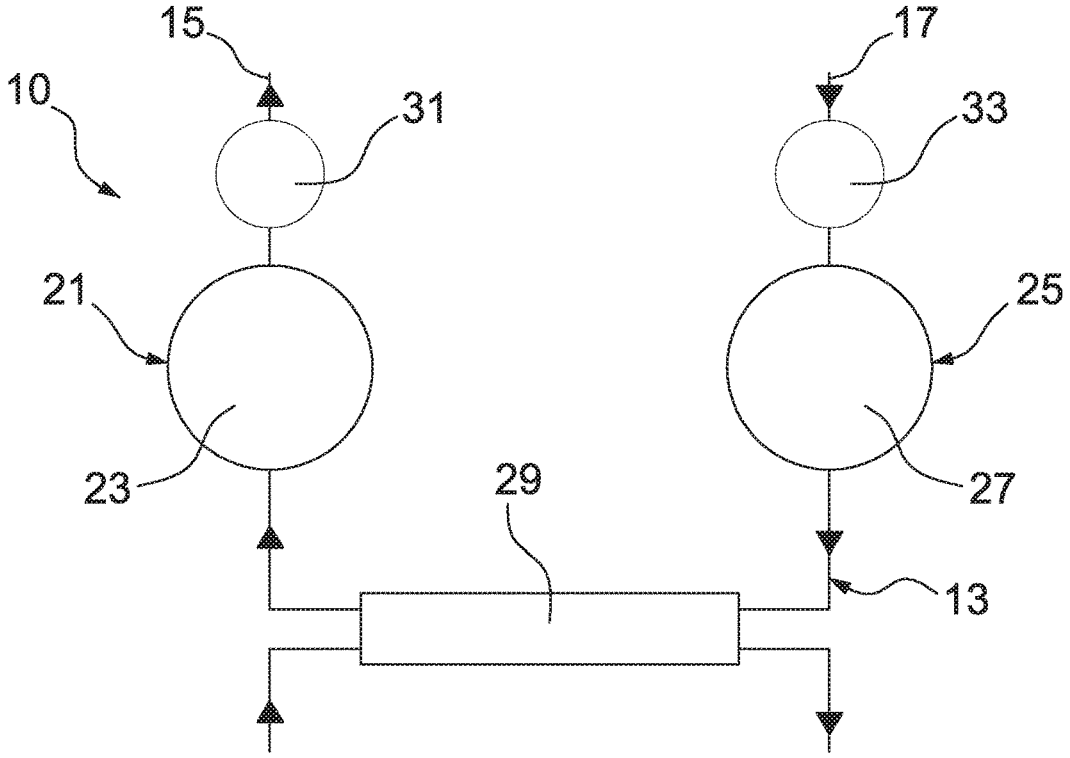
FIG. 2 is a view similar to FIG. 1, except that the air conditioning system is configured for operation in a cooling mode.
Figure 3:
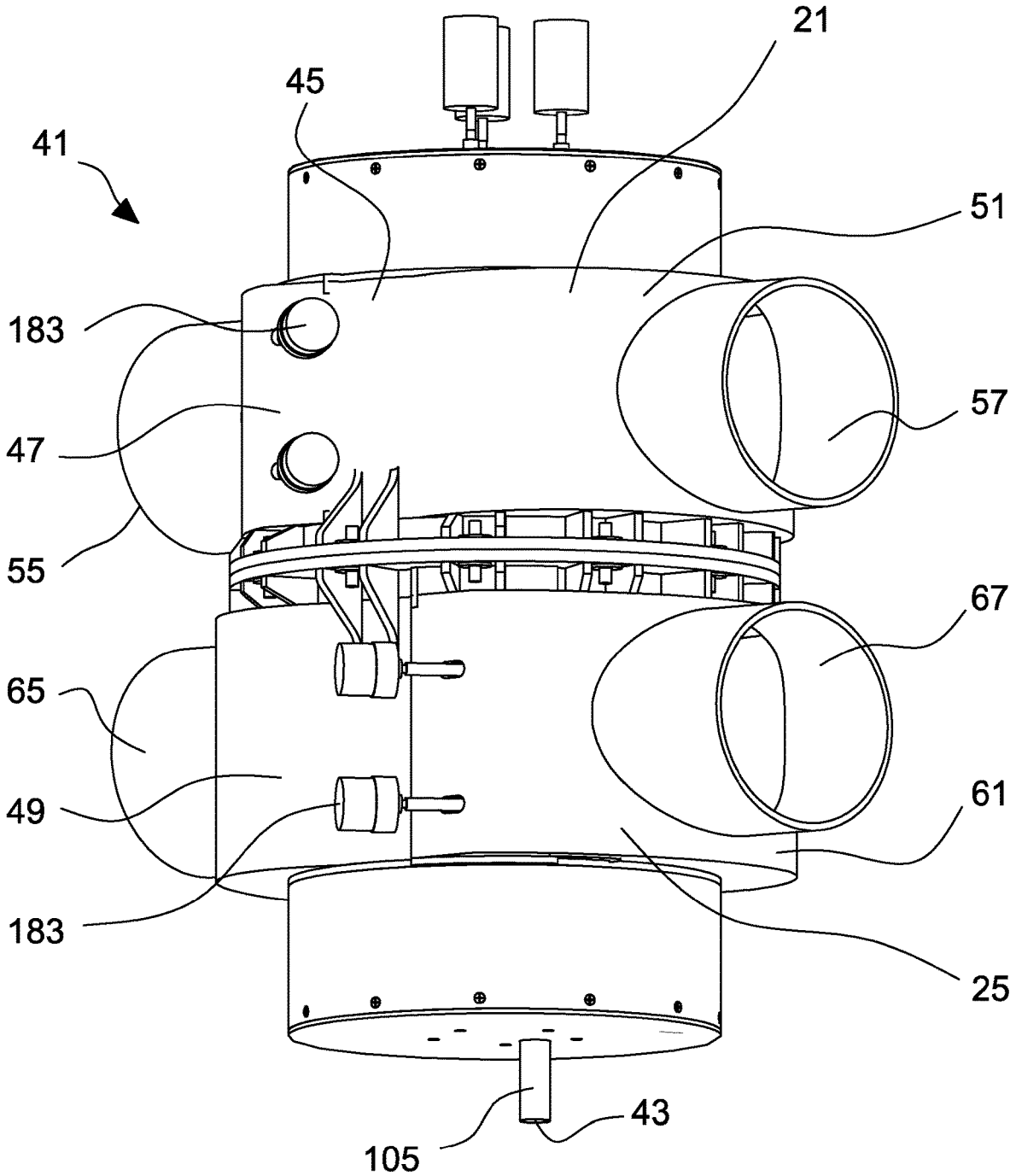
FIG. 3 is a three-dimensional view of a rotary machine incorporating an expansion side having an expander and a compression side having a compressor within the air-conditioning system.
Figure 4:
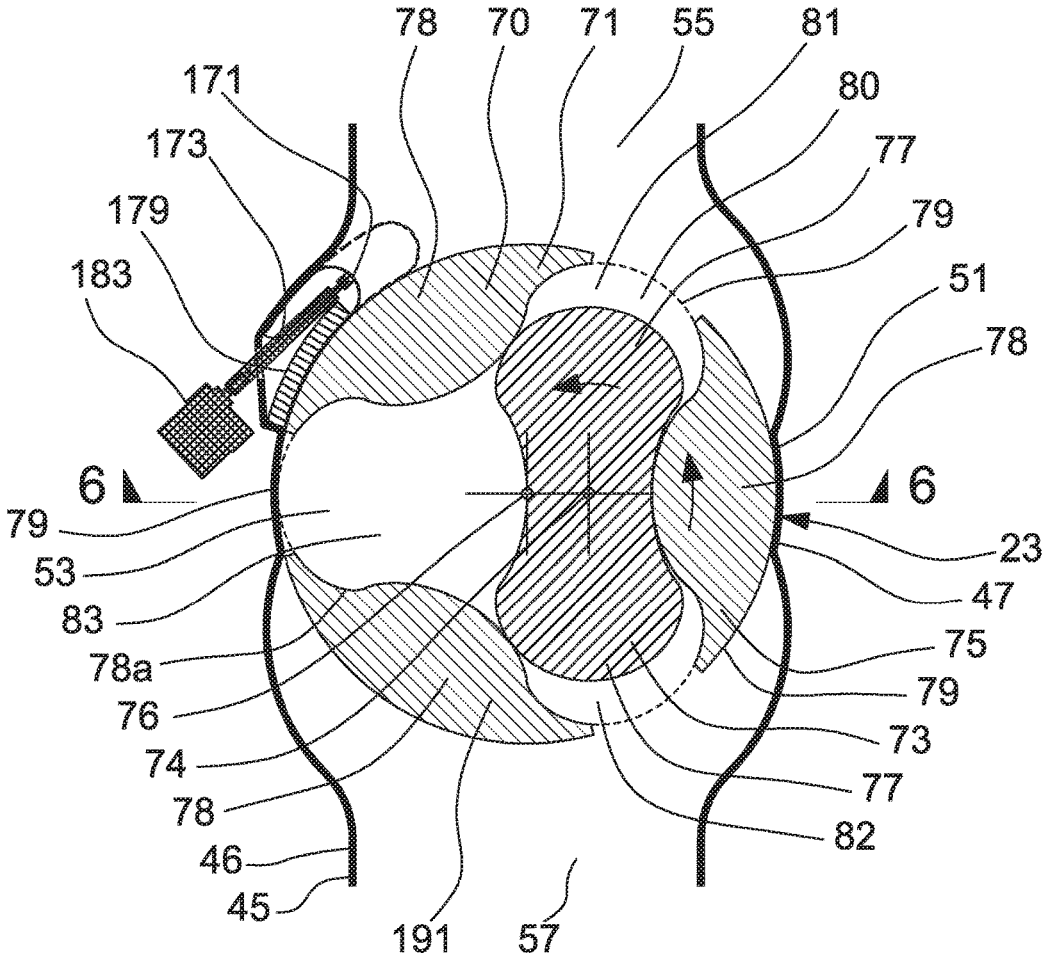
FIG. 4 is a cross-sectional view of part of the rotary machine of FIG. 3, illustrating the expansion side.
Figure 5:
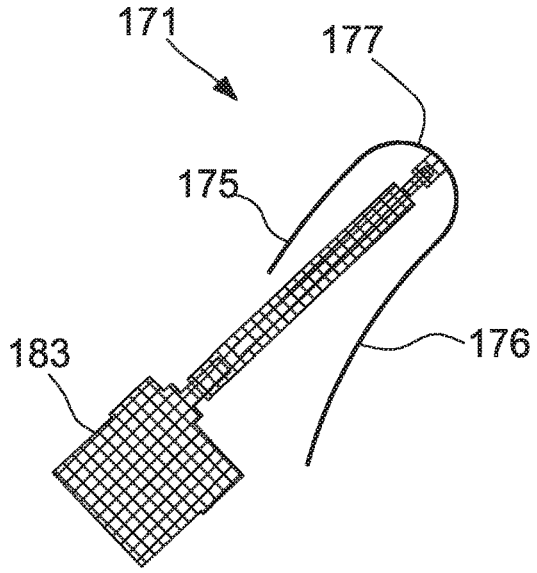
FIG. 5 is a schematic view of a cut-off mechanism within the expansion side, as shown in FIG. 4.
Figure 6:
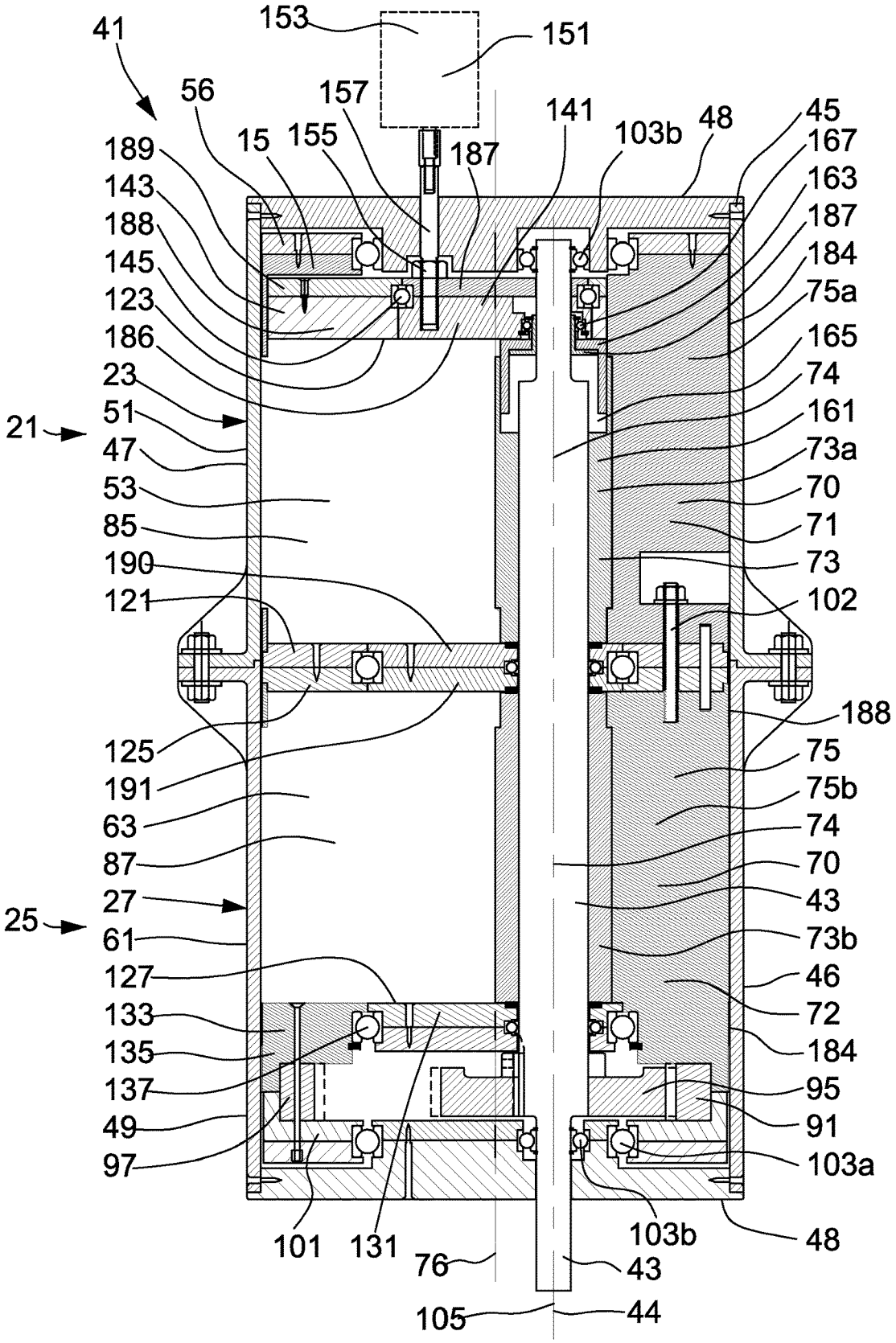
FIG. 6 is a sectional view on line 6-6 of FIG. 4.
Figure 7:
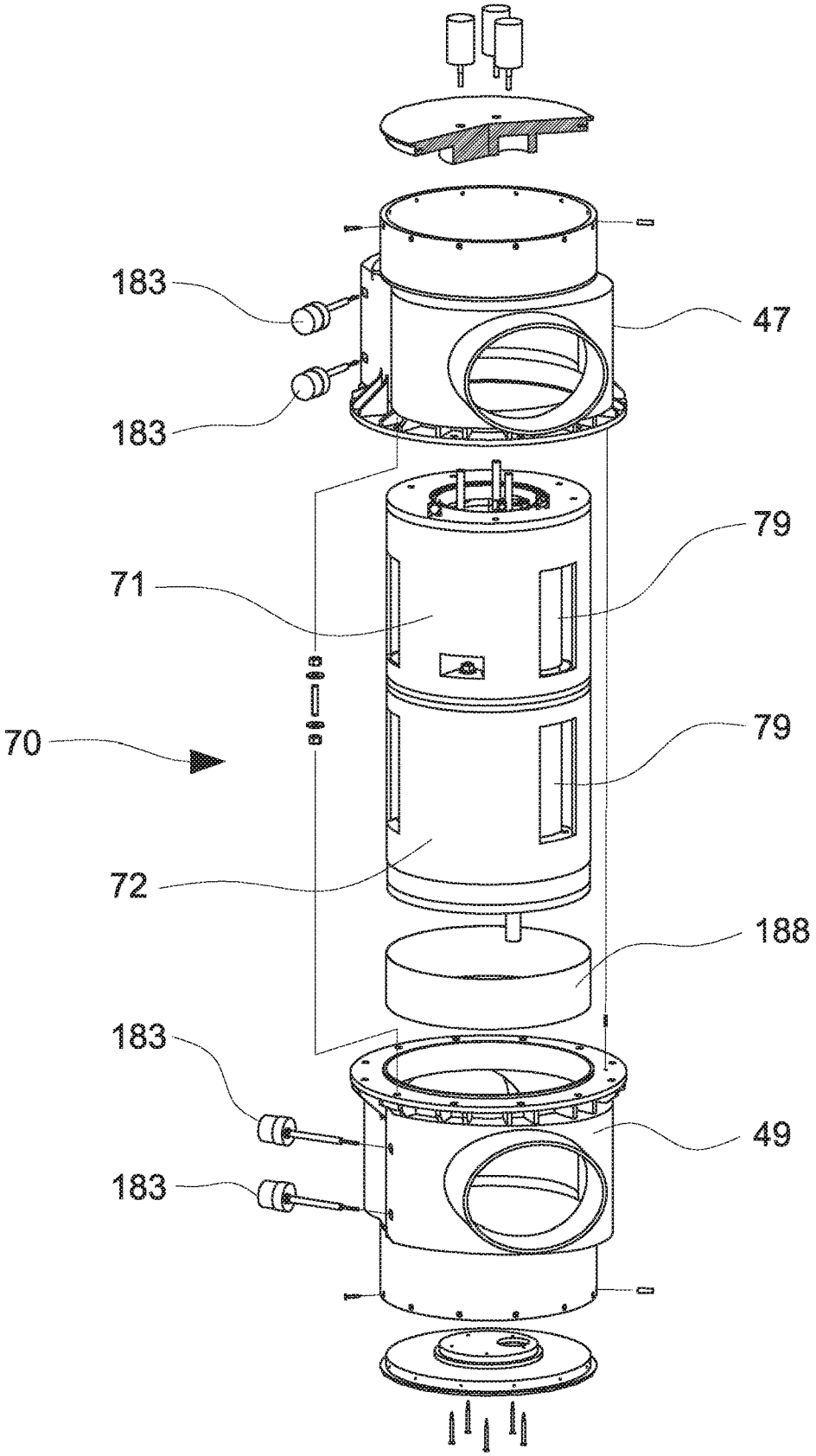
FIG. 7 is an exploded three-dimensional view of the rotary machine, illustrating various parts thereof.

The air-conditioning system 10 is depicted schematically in FIGS. 1 and 2, wherein FIG. 1 represents the heating cycle and FIG. 2 represents the cooling cycle.

The air-conditioning system 10 establishes a flow path 13 for air between two ends 15, 17, both of which communicate with the space. Air moving along the flow path 13 between two ends 15, 17 provides the working medium for the Bell-Coleman cycle.

The air-conditioning system 10 has an expansion side 21 comprising an expander 23, and a compression side 25 comprising a compressor 27. The expander 23 and the compressor 27 are incorporated in the flow path 13, and a heat exchanger 29 is provided in the flow path 13 between the expansion side 21 and compression side 25. The heat exchanger 29 will hereinafter be referred to as the principal heat exchanger.

Typically, the flow path 13 would be defined by ductwork and the two ends 15, 17 would communicate with the space in any appropriate way; for example, through registers, diffusers, or grills (not shown).

Sound dampeners 31, 33 are also provided in the flow path 13. In the arrangement shown, sound dampener 31 is located in close proximity to the end 15 of flow path 13 and sound dampener 33 is located in close proximity to the end 17.

While not shown in the drawings, the air conditioning system 10 may include various other components and features, including a pump to produce appropriate pressure in the principal heat exchanger 29 and duct work at start-up. The pump would typically be controlled by a microprocessor. Further there may be one or more pumps and associated componentry operable to introduce fresh air into the system.

A second heat exchanger (not shown) may be provided to enhance the efficiency of the air-conditioning system 10. The second heat exchanger may be employed to maximise efficiency when the temperature of the space nears target. With the second heat exchanger, air drawn in from the air-conditioned space, exchanges heat with air exiting the principal heat exchanger 29 before re-entering the air conditioning system 10. The air-conditioning system 10 may use nearby ground or groundwater as a heat sink or heat source. This may increase the efficiency significantly compared with conventional air conditioning systems which typically rely on external air. Other forms of heat sink or heat source could of course also be used.

A third heat exchanger (not shown) may be provided to enhance efficiency of the air-conditioning system 10. The third heat exchanger may be employed to warm or cool incoming air to the temperature of the heat source or heat sink before entering the air conditioning system 10.

With the arrangement shown in FIG. 1, which represents the heating cycle, where incoming air enters the expander 23 at the expansion side 21 and leaves from the compressor 27 at the compression side 25. In this arrangement, end 15 of flow path 13 functions as an air inlet and end 17 functions as an air outlet. In the heating cycle, air is drawn from a space to be heated through inlet 15 and expanded adiabatically within expander 25, thereby reducing the pressure and temperature. Adiabatic expansion may be achieved by simply increasing the air volume rapidly, so there is little time for heat to flow from or to boundary surfaces. The air is then passed through principal heat exchanger 29 and warmed to the temperature of the heat source without changing the pressure. The air is then compressed adiabatically to atmospheric pressure within the compressor 27, which increases the temperature, and then returned to the space to be heated through outlet 17. Adiabatic compression may be achieved by simply decreasing the air volume rapidly, so there is little time for heat to flow from or to boundary surfaces.

With the arrangement shown in FIG. 2, which represents the cooling cycle, the air flow is reversed. In this arrangement, end 15 of flow path 13 functions as an air outlet and end 17 functions as an air inlet. In the cooling cycle, air is drawn from a space to be cooled through inlet 17 and compressed adiabatically within compressor 27, thereby increasing the pressure and temperature. Adiabatic compression may be achieved by simply decreasing the air volume rapidly, so there is little time for heat to flow from or to boundary surfaces. The air is then passed through principal heat exchanger 29 which reduces the temperature to that of the heat sink without changing the pressure. The air is then expanded adiabatically in expander 23 to atmospheric pressure, which reduces the temperature, and then returned to the space to be cooled through outlet 15. Adiabatic expansion may be achieved by simply increasing the air volume rapidly, so there is little time for heat to flow from or to boundary surfaces.

The temperatures and pressures vary according to the temperature of incoming air and the manner in which a user chooses to operate the air-conditioning system 10.

By way of a non-limiting example, in the heating cycle, a typical incoming air temperature might be 16 C (since incoming air would be preheated in a heat exchanger to approximately the temperature of ground water, if initially below 16 C). The pressure in an expansion chamber of the expander 23 might typically vary between approximately 77 kPa (absolute) and 86 kPa and the temperature might typically vary between approximately 0 C and 8 C. Similarly, in the cooling cycle, a typical incoming air temperature might be 18 C (since it would be precooled to approximately the temperature of ground water). The pressure in a compression chamber of the compressor 27 might vary between approximately 120 kPa (absolute) and 106 kPa and temperature might typically vary between 38 C and 26 C.

The expander 23 and compressor 27 are drivingly interconnected whereby rotational drive applied to one is transmitted directly to the other. In this embodiment, the expander 23 and compressor 27 are integrated in a rotary machine 41.

The rotary machine 41 is configured to provide the expansion side 21 and compression side 25 of the air-conditioning system 10. In the arrangement shown, the expansion side 21 and compression side 25 are disposed axially within the rotary machine 41, as will be explained in more detail shortly.

The rotary machine 41 comprises a drive shaft 43 and a casing 45 which provides an expansion housing 47 and a compression housing 49. The casing 45 comprises a profiled side 46 and two opposed ends 48.

Figure 8:
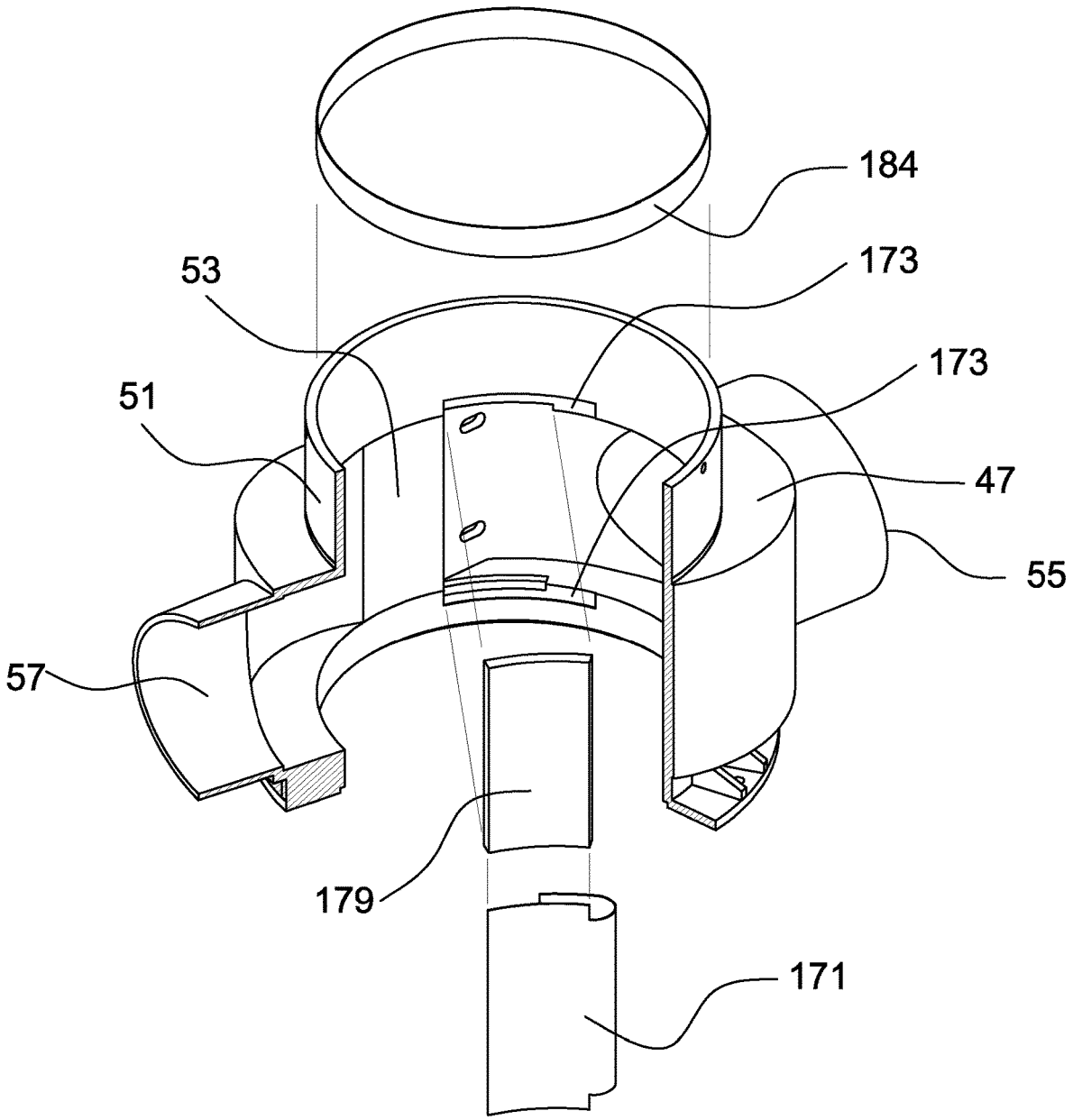
FIG. 8 is an exploded three-dimensional view of an expansion housing within the expansion side of the rotary machine.
Figure 9:
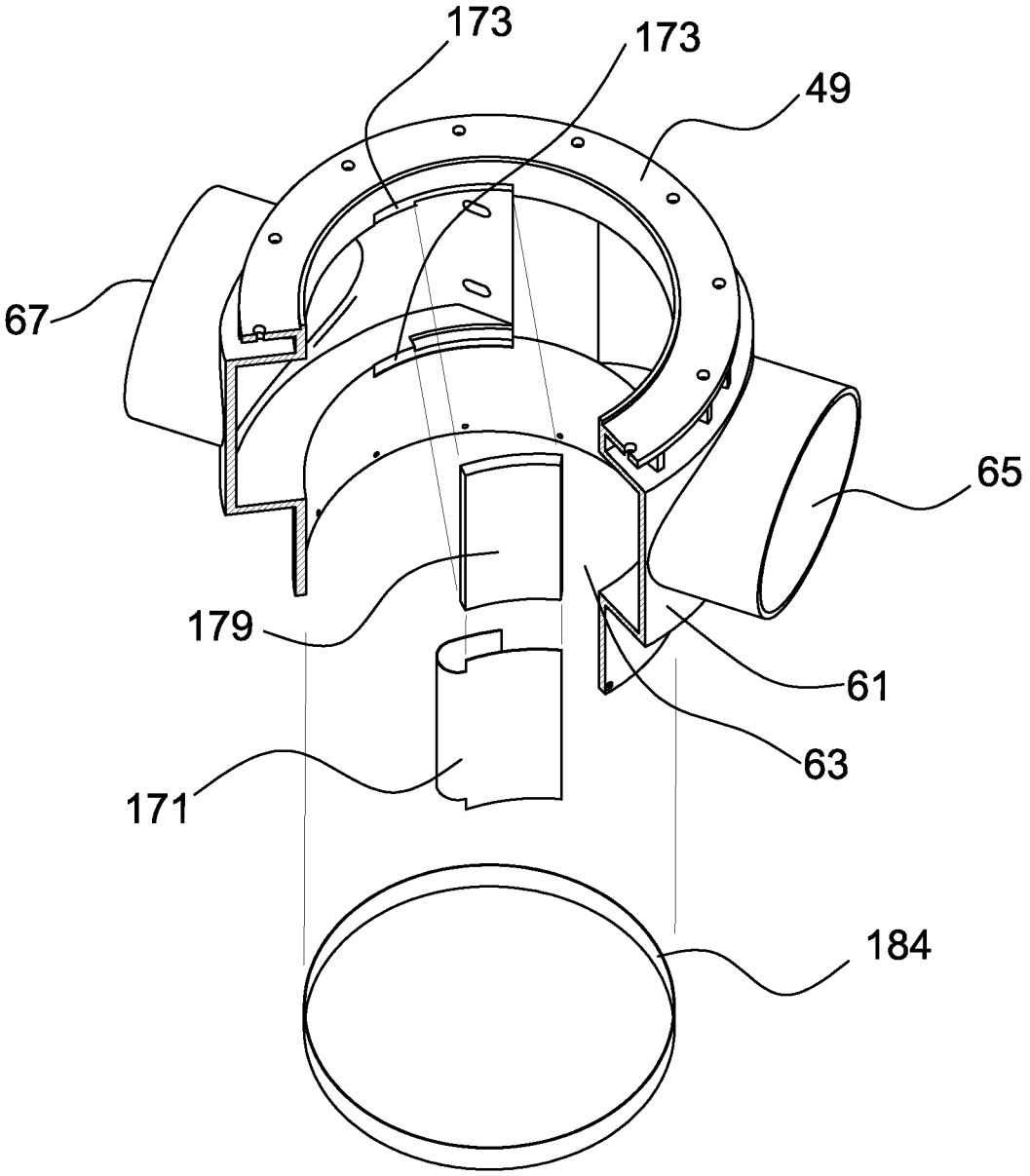
FIG. 9 is an exploded three-dimensional view of a compression housing within the compression side of the rotary machine.
Figure 10:
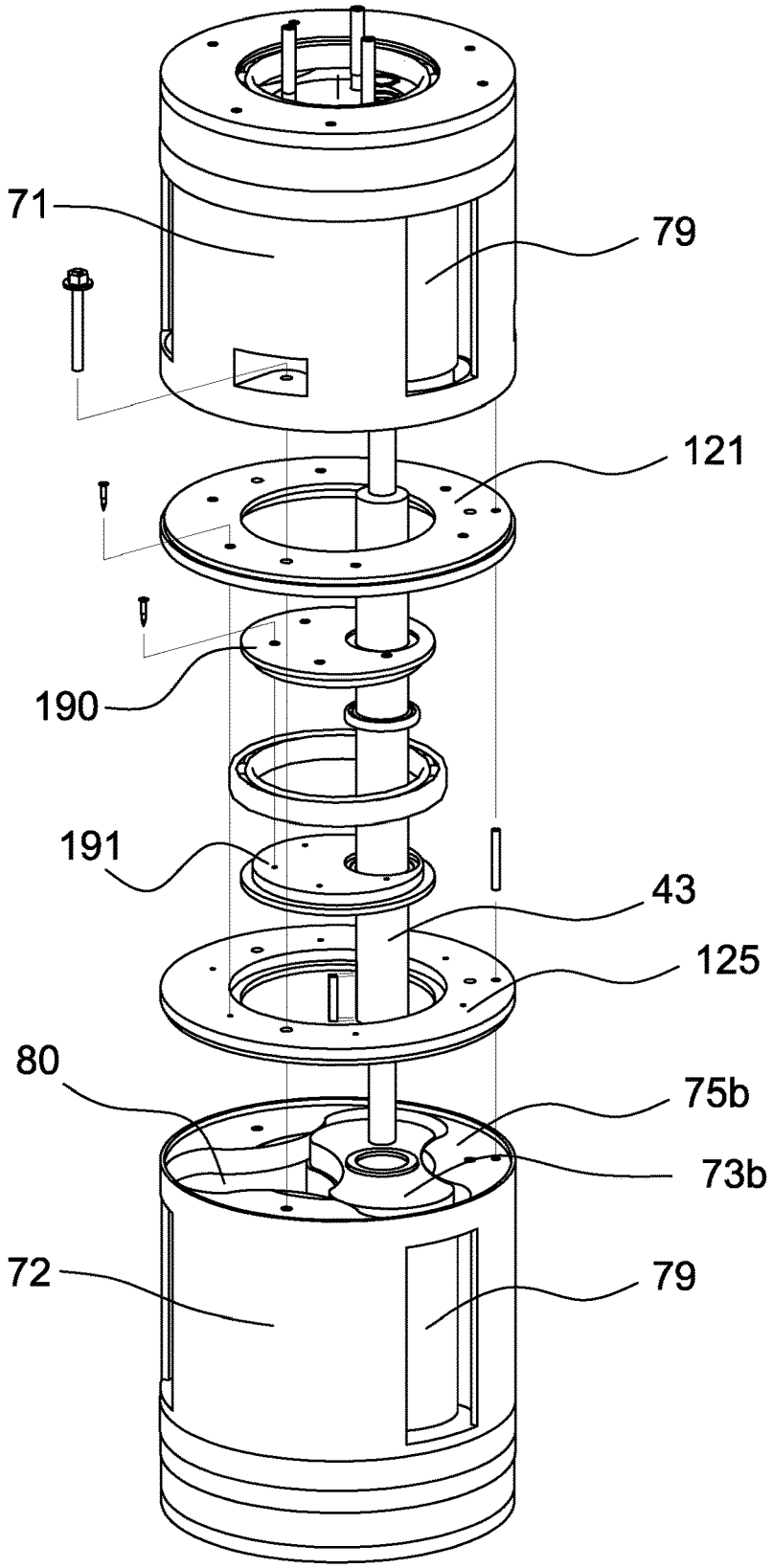
FIG. 10 is an exploded three-dimensional view of an expansion rotor assembly and a compression rotor assembly within the rotary machine, together with various components coupling the two rotor assemblies together.

The expansion housing 47 comprises a side wall 51 defining a central cavity 53, and an inlet 55 and an outlet 57 opening onto the central cavity 53, as best seen in FIG. 8. The compression housing 49 comprises a side wall 61 defining a central cavity 63, and an inlet 65 and an outlet 67 opening onto the central cavity 63, as best seen in FIG. 9. In the arrangement shown, the cylindrical side wall 51 of the expansion housing 47 and the cylindrical side wall 61 of the compression housing 49 comprise two sections of the side 46 of the casing 45 which are connected together.

The rotary machine 41 further comprises two rotor assemblies 70, one associated with the expander 23 and the other associated with the compressor 27. The two rotor assemblies 70 may at times be hereinafter referred to individually as an expansion rotor assembly 71 and a compression rotor assembly 72. The expansion rotor assembly 71 is accommodated within the expansion housing 47 to provide the expander 23, and the compression rotor assembly 72 is accommodated within the compression housing 49 to provide the compressor 27.

Each rotor assembly 70 comprises an inner rotor 73 adapted to rotate about axis 74 and an outer rotor 75 adapted to rotate about axis 76. In other words, the two inner rotors 73 rotate about common axis 74 and the two outer rotors 75 rotate about common axis 76. The two axes 74, 76 are laterally offset and parallel.

The inner rotor 73 and the outer rotor 75 may each be formed from any suitable material, including for example plastics material (including an engineering plastics material) or metal. An example of a material believed to be suitable for the inner rotor 73 and the outer rotor 75 is PVC.

The rotor assembly 70 may be of any suitable configuration, and the expansion rotor assembly 71 and the compression rotor assembly 72 need not necessarily be of the same configuration. In the arrangement illustrated, the expansion rotor assembly 71 and the compression rotor assembly 72 are of the same configuration.

In the arrangement shown, each rotor assembly 70, the inner rotor 73 comprises an externally-lobed rotor, and the outer rotor 75 comprises an internally-lobed rotor, whereby the externally-lobed inner rotor is rotatable inside the internally-lobed outer rotor.

The inner and outer rotors 73, 75 rotate at different rates, with the inner rotor rotating faster than the outer rotor. In this embodiment, with the inner rotor 73 may rotate at a rate which is approximately 50% faster than the outer rotor 75. A typical rotational speed of the inner rotor 73 would be about 2,800 RPM and the outer rotor 75 about 1,866 RPM.

The inner rotor 73 comprises a plurality of external lobes 77, there being two external lobes 77 in diametrally opposed relation in the arrangement shown.

Figure 11A:
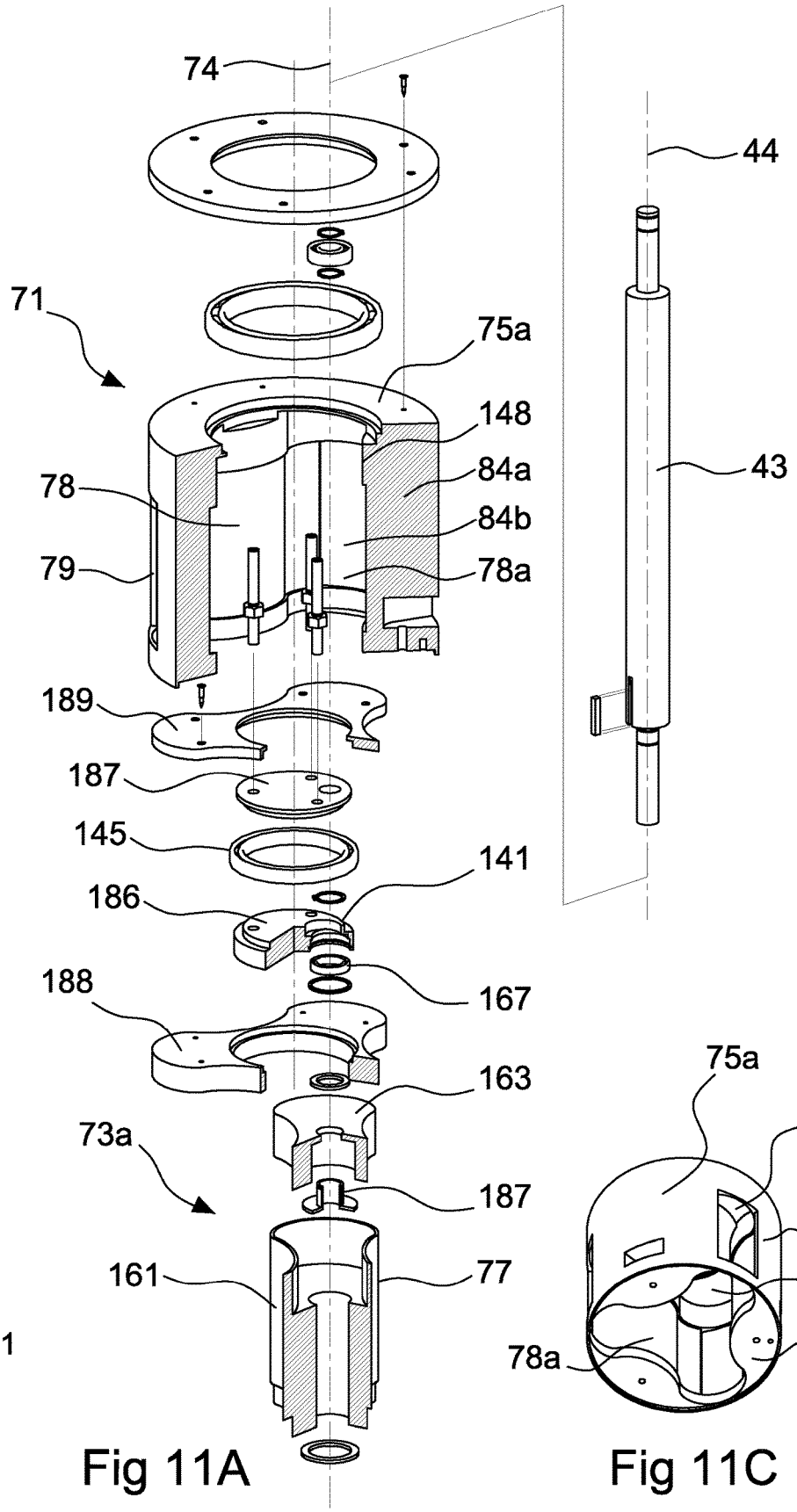
FIG. 11A is an exploded three-dimensional view of the expansion rotor assembly.
Figure 11B:
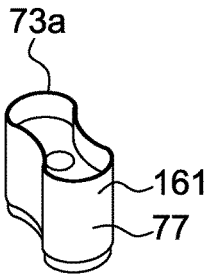
FIG. 11B is a perspective view of the inner rotor of the expansion rotor assembly.
Figure 11C:
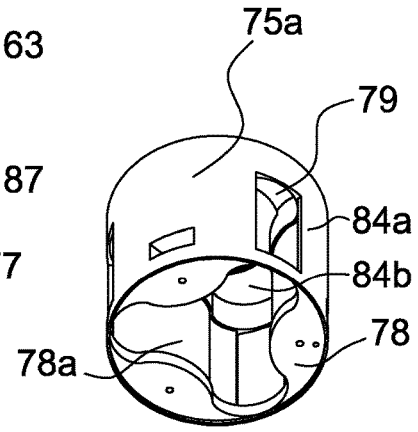
FIG. 11C is a perspective view of the outer rotor of the expansion rotor assembly.
Figure 12:
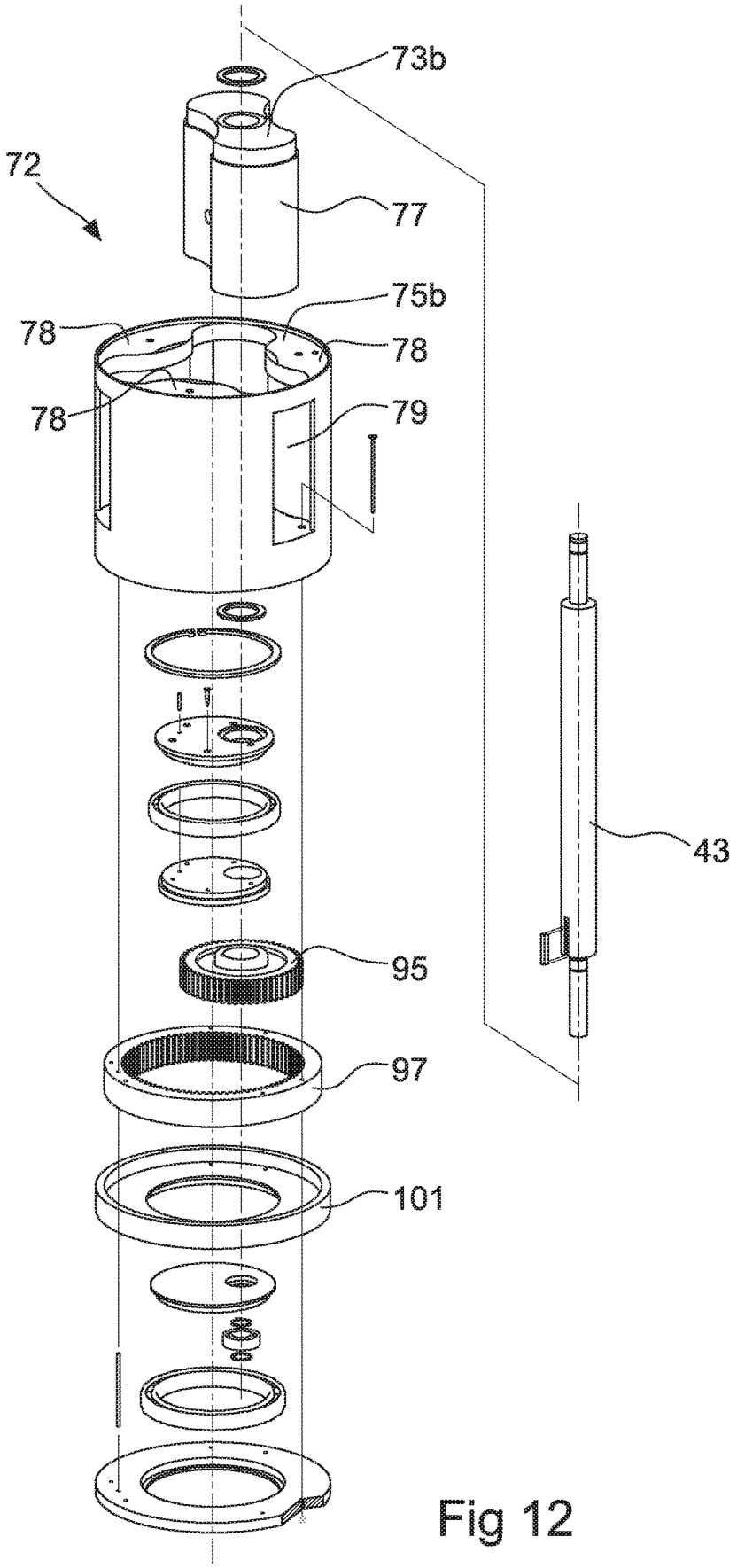
FIG. 12 is an exploded three-dimensional view of the compression rotor assembly and gear transmission.

The outer rotor 75 comprises a plurality of internal lobes 78 in circumferentially spaced relation, there being three internal lobes 78 in the arrangement shown. More particularly, the outer rotor 75 comprises a hollow body **84*a* defining a central cavity 84*b*, as best seen in FIGS. 11A and 11C. The internal lobes 78 present an internal surface 78*a* which bounds the central cavity 84*b* within the body 84*a*. The inner rotor 73 is received within the central cavity 84*b* of the outer rotor 75**.

In this embodiment, the external lobes 77 of the inner rotor 73 and the internal lobes 78 of the outer rotor 75 are of an epicyclic configuration.

The external lobes 77 and internal lobes 78 do not contact each during a rotation cycle of the rotor assembly 70.

Ports 79 are provided in the outer rotor 75 between adjacent internal lobes 78.

With respect to each rotor assembly 70, the inner and outer rotors 73, 75 are configured to define a plurality of inter-lobe zones 80 which are in circumferentially spaced relation and each of which changes continuously in volume during a rotation cycle of the rotor assembly. While the external lobes 77 and internal lobes 78 do not contact each during a rotation cycle of the rotor assembly, they are configured to be so closely spaced that the gap between them remains very small at all times. Because of the rapid speed of rotation of the rotor assembly 70 and relatively low pressures, there is negligible leakage between the external lobes 77 and internal lobes 78. Thus, the zones 80 are effectively sealed at locations between the external lobes 77 and internal lobes 78.

In the arrangement shown in which the inner rotor 73 comprises two external lobes 77 in diametrally opposed relation and the outer rotor 75 comprises three internal lobes 78 in circumferentially spaced relation, the inner and outer rotors 73, 75 cooperate to define three said zones 80. The three zones 80 may hereinafter be referred to individually as zones 81, 82 and 83. With this arrangement, the three ports 79 defined between adjacent internal lobes 78 on the outer rotor 75 respectively communicate with the three zones 81, 82, 83.

The zones 80 within the expansion rotor assembly 71 constitute expansion chambers 85 which move sequentially into and out of registration with the inlet 55 and outlet 57 within the expansion housing 47, as will be explained in more detail later. Similarly, zones 80 within the compression rotor assembly 72 constitute compression chambers 87 which move sequentially into and out of registration with the inlet 65 and outlet 67 within the compression housing 49, as will also be explained in more detail later. In the case of the expansion rotor assembly 71, the volume of each zone 80 continuously increases between the inlet 55 and outlet 57 as the rotor assembly rotates. In the case of the compression rotor assembly 72, the volume of each zone continuously decreases between the inlet 65 and outlet 67 as the rotor assembly rotates.

The relative volumes of the expansion and compression chambers 85, 87 are selectively variable to vary the volume ratio therebetween to optimise efficiency in varying environments and user preferences. This is achieved in this embodiment by selectively varying the volume of the expansion chambers 85, as will be described in more detail later.

Each inner rotor 73 is rigidly mounted on the drive shaft 43 for rotation therewith. The drive shaft 43 has an axis of rotation 44, and the axis 74 of each inner rotor 73 is coincident with the axis of rotation 44 of the drive shaft. The drive shaft 43 provides a direct connection between the two inner rotors 73*a*, 73*b* (and hence a direct connection between the two rotor assemblies 71, 72) for transmission of rotational torque from one to the other without any loss of energy due to friction.

The inner rotor 73 of the expander rotor assembly 71 may hereinafter referred to sometimes as inner rotor 73*a*, and the inner rotor 73 of the compressor rotor assembly 72 may hereinafter referred to sometimes as inner rotor 73*b*. Similarly, the outer rotor 75 of the expander rotor assembly 71 may hereinafter referred to sometimes as outer rotor 75*a*, and the outer rotor 75 of the compressor rotor assembly 72 may hereinafter referred to sometimes as outer rotor 75*b*.

The outer rotor 75*b* of the compression rotor assembly 72 is drivingly connected to the drive shaft 43 through a drive transmission 91, with the axis of rotation 76 of the outer rotor 75*b* being parallel to and offset with respect to the axis of rotation 44 of the drive shaft 43. In the arrangement shown, the drive transmission 91 comprises a gear assembly having an external gear 95 and an internal gear 97 meshing together. The external gear 95 is configured as a drive pinion mounted on the drive shaft 43 and the internal gear 97 is connected to the outer rotor 75*b* of the compression rotor assembly 72. The internal gear 97 is carried on a gear retainer 101 which rotates with the internal gear 97 on bearing 103*a* supported on adjacent end 48 of the casing 45.

The outer rotor 75*a* of the expansion rotor assembly 71 is connected to the outer rotor 75*b* of the compression rotor assembly 72 to rotate in concert therewith. In other words, the two outer rotors 75*a* and 75*b* are coupled directly together and rotate as a unit. The connection 102 between the two outer rotors 75*a* and 75*b* may be provided in any appropriate way, and in the arrangement shown comprises a bolted connection and locating pin. With this arrangement, rotational drive applied to the inner rotors 73 via the drive shaft 43 is also transmitted to the outer rotors 75 through the drive transmission 91 and the interconnection between the two outer rotors.

The drive shaft 43 may be caused to rotate in any appropriate way; for example, rotational torque may be applied to the drive shaft 43 by way of a drive motor such as an electric motor. In the arrangement shown, the drive shaft 43 is rotatably supported within the casing 45 by bearing assemblies 103*b*. Further, the drive shaft 43 has end section 105 outwardly from the casing 45 for coupling to a drive motor.

The expansion housing 47 further comprises an inner wall 121 and an outer wall 123 which define opposed ends of the expansion chambers 85 defined by zones 80. The compression housing 49 further comprises an inner wall 125 and an outer wall 127 which define opposed ends of the compression chambers 87 defined by zones 80.

The two inner walls 121, 125 have radially inner portions 190, 191 respectively which are fixed against rotation.

The outer wall 123 of the expansion chambers 85 will be discussed further later.

The outer wall 127 of the compression chambers 87 comprises a radially inner section 131 and a radially outer section 133. The radially inner section 131 is fixed against rotation and the radially outer section 133 rotates in unison with the outer rotor 75. More particularly, the radially outer section 133 comprises an end portion 135 of the outer rotor 75*b*. A bearing 137 is provided between the radially inner and outer sections 131, 133 to accommodate relative rotation therebetween.

In this embodiment, the volume of the expansion chambers 85 can be varied (as mentioned above) to optimise efficiency in varying environments and user preferences.

In the arrangement shown, this is effected by varying the effective length of the inner rotor 73*a* and the internal volume of the outer rotor 75*a*.

In relation to the outer rotor 75*a*, the outer wall 123 is configured to be adjustable to permit variation of the volume of each of the expansion chambers 85. Specifically, the outer wall 123 comprises a radially inner section 141 which comprises a central core 186 and a cap 187, and a radially outer section 143 which comprises a plug 188 and a cap 189. The radially inner section 141 is fixed against rotation and the radially outer section 143 rotates in unison with the outer rotor 75*a*. Further, the radially inner section 141 is selectively movable axially within the central cavity 84*b* of the hollow body 84*a*, towards and away from the expansion chambers 85 to vary the volume of each expansion chamber.

The outer wall 123 is in effect a plug movable within hollow body 84*a* along the central cavity 84*b* bounded by an internal surface 78*a* of the internal lobes 78. The radially outer section 143 is coupled to the radially inner section 141 to move axially in unison with the radially inner section 141 while rotating relative thereto. Specifically, a bearing 145 is provided between the radially inner section 141 and the radially outer section 143 to facilitate the relative rotation therebetween and also transmit axial movement of the radially inner section 141 to the radially outer section 143. With movement of the radially inner section 141 and the radially outer section 143 axially in unison within the hollow body 84*a* along the central cavity 84*b* bounded by the internal surface 78*a* of the internal lobes 78, the volume of each expansion chamber 85 is varied, either increasing or decreasing according to the direction of movement.

The radially inner section 141 may be caused to move axially towards and away from the expansion chambers 85 in any appropriate way. In the arrangement shown, adjustment mechanism 151 is provided for this purpose. The adjustment mechanism 151 comprises actuator 153 such as a stepper motor operably connected to the radially inner section 141 through a connection 155 comprising studs 157.

The inner rotor 73*a* is configured to comprise a main section 161 and an end section 163 axially movable with respect to the main section 161. The effective length of the inner rotor 73*a* can be adjusted by axial movement of the end section 163 with respect to main section, effectively expanding or contracting the length of the inner rotor 73*a*, according to the direction of movement. In the arrangement shown, the main section 161 incorporates an end cavity 165 and the end section 163 is slidably received and retained in the cavity 165.

The end section 163 of the inner rotor 73*a* is connected, via actuator 187 and bearing 167, to the radially inner section 141 of the outer wall 123 of the zones 80 defining the expansion chambers to move axially in unison therewith. In this way, actuation of the adjustment mechanism 151 effects not only variation of the volume of the expansion chambers but also variation of the effective length of the inner rotor 73*a*.

Rotor assembly 71 may be provided with means for selectively varying the timing of registration of the respective ports 79 of the outer rotor 75*a* with the inlet 55 with which it communicates. Rotor assembly 72 may be provided with means for selectively varying the timing of registration of the respective ports 79 of the outer rotor 75*b* with the outlet 67. This variation may be achieved by varying the size of each respective inlet 55 and outlet 67 (with reference to the direction of angular movement of the respective ports), thereby varying the extent of registration between the respective port 79 and the inlet 55 and the outlet 67 (as the case may be) as the port sweeps past the inlet or outlet during rotation of the rotor assembly 70. More particularly, the inlet 55 may be selectively variable to adjust the point at which the respective ports 79 in rotor assembly 71 move out of registration with the inlet 55 in the expansion side 21. Similarly, the outlet 67 may be selectively variable to adjust the point at which the respective ports 79 in rotor assembly 72 move into registration with the outlet 67 in the compression side 25.

In this embodiment, there is provided a respective cut-off element 171 selectively movable relative to the inlet 55 and a respective cut-off element 171 selectively movable relative to the outlet 67. The cut-off elements 171 are respectively operable to increase or decrease the size of the inlet 55 or outlet 67 (with reference to the direction of angular movement of the respective ports 79).

Each cut-off element 171 is slidably supported between a surface 173 of the casing 45 and retaining rings 184 and 188. The cut-off element 171 comprises two side sections 175, 176 and a curved bridge section 177 between the two side sections. The cut-off element 171 is so disposed that side section 176 slidingly engages surface 173 of the casing 45. A backing plate 179 is provided to retain a seal with the respective outer rotor 75*a* and 75*b* when cut-off element 171 is in an extended position. With this arrangement, sliding movement of the cut-off element 171 advances and retracts the curved bridge section 177 with respect to the inlet 55 of the expansion side 21 or outlet 67 of the compression side 35, thereby varying the size of the inlet 55 or outlet 67. More particularly, in the expansion side 21 the curved bridge section 177 defines a trailing edge 181 of the inlet 55, being a point at which the respective ports 79 move out of registration with the inlet during a rotation cycle of the respective rotor assembly 71. With this arrangement, the location of the trailing edge 181 of the inlet 55 varies with sliding movement of the respective cut-off element 171. In the compression side 25, the curved bridge section 177 defines the leading edge of the outlet 67, being a point at which the respective ports 79 move into registration with the outlet during a rotation cycle of the respective rotor assembly 72. With this arrangement, the location of the leading edge of the outlet 67 varies with sliding movement of the respective cut-off element 171.

Actuators 183 are provided for selectively moving the respective cut-off elements 171 for varying the trailing edge 181 of the inlet 55 of the expansion side 21 and the leading edge 189 of the outlet 67 of the compression side 25.

All processes in the function of the air-conditioning system 10 may be controlled by a microprocessor (not shown) to optimise efficiency in varying environments and user preferences. The microprocessor may control operation of the actuators 183, as well as operation of actuator 153 to vary the volume of the expansion chambers 85.

Figure 13:
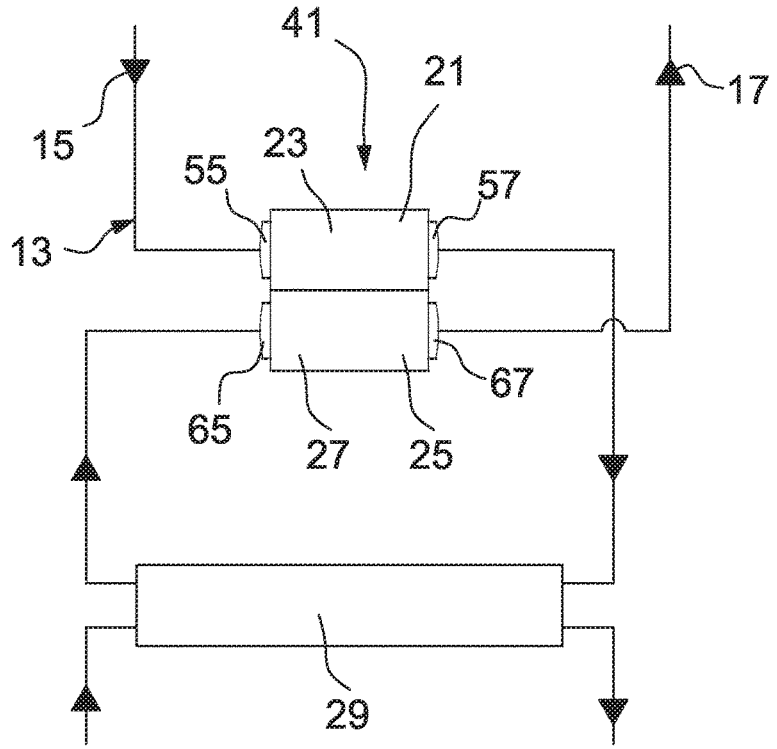
FIG. 13 is a schematic view of the air-conditioning system incorporating the rotary machine configured for operation in the heating mode.
Figure 14:
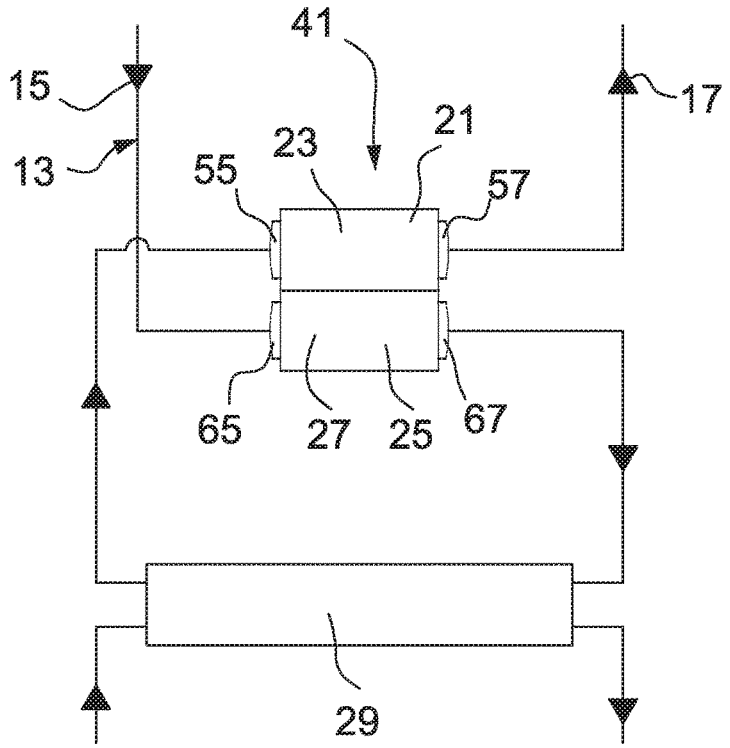
FIG. 14 is a schematic view of the air-conditioning system incorporating the rotary machine configured for operation in the cooling mode.

A typical installation of the rotary machine 41 configured for a heating mode is depicted schematically in FIG. 13 and a typical installation of the rotary machine 41 configured for a cooling mode is depicted schematically in FIG. 14.

Referring to FIG. 13 (which relates to the heating cycle), the inlet 55 of the expander 23 within the rotary machine 41 is connected to end 15 of flow path 13 which constitutes an inlet. The outlet 57 of the expander 23 within the rotary machine 41 is connected to one end of the principal heat exchanger 29. The other end of the principal heat exchanger 29 is connected to the inlet 65 of the compressor 27 within the rotary machine 41. The outlet 67 of the compressor 27 within the rotary machine 41 is connected to end 17 of flow path 13 which constitutes an outlet. With the arrangement, air is drawn from a space to be heated through inlet 15 and expanded adiabatically within the expander 23, thereby reducing the pressure and temperature. The air is then passed through the principal heat exchanger 29 and warmed to a temperature of the heat source without changing the pressure. The air is then compressed adiabatically to atmospheric pressure within the compressor 27, which increases the temperature, and then returned to the space to be heated through outlet 17.

Referring to FIG. 14 (which relates to the cooling cycle), the inlet 65 of the compressor 27 within the rotary machine 41 is connected to the end 15 of flow path 13 which constitutes an inlet. The outlet 67 of the compressor 27 is connected to one end of the principal heat exchanger 29. The other end of the principal heat exchanger 29 is connected to the inlet 55 of the expander 23 within the rotary machine 41. The outlet 57 of the expander 23 within the rotary machine 41 is connected to end 17 of flow path 13 which constitutes an outlet. With the arrangement, air is drawn from a space to be cooled through inlet 15 and compressed adiabatically within the compressor 27, thereby increasing the pressure and temperature. The air is then passed through the principal heat exchanger 29 which reduces the temperature to that of the heat sink without changing the pressure. The air is then expanded adiabatically in the expander 23 to atmospheric pressure, which reduces the temperature, and then returned to the space to be cooled through outlet 17.

In practical terms, the various components of the air conditioning system 10 illustrated schematically in FIGS. 13 and 14 are connected by ductwork, with a control system incorporating a series of valves being provided to establish air flow paths in the respective directions required for heating and cooling.

Fresh air may be introduced into the flow before it enters the principal heat exchanger 29 and a corresponding amount of air is removed as the flow exits the principle heat exchanger. The volume of fresh air can be varied to suit individual circumstances. In the heating cycle, energy harvested from the inflow can be used to assist in extracting air from the outflow. In the cooling cycle, energy recovered from the outflow can be used to assist in introducing air to the inflow. Settings can be adjusted so that no air is removed from the system when air is added for ventilation. In this case a positive pressure is generated in the air-conditioned space, which prevents any drafts that may be caused by inadequate sealing of doors, windows etc.

Operation of the rotary machine 41 will now be described with reference to FIGS. 15*a* to 15*l* which depict the operation of expander 23. The expansion rotor assembly 71 of the expander 23 is shown at various stages of its cycle of rotation, with the outer rotor 75*a* being shown at 20-degree increments of rotation. The inter-lobe zones 81, 82 and 83 (each of which constitutes an individual expansion chamber 85) are at various stages of expansion and contraction within the rotation cycle of the rotor assembly 71. Progress of the inter-lobe zone 81 is tracked.

Figure 15A:
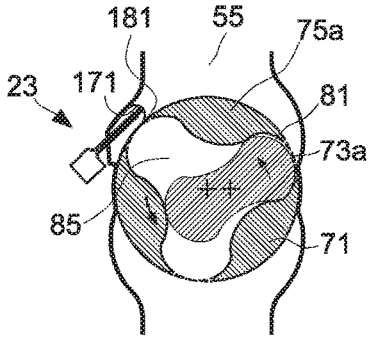
FIG. 15 is a series of sequential views illustrating the expansion side of the rotary machine, and depicting in particular the expansion rotor assembly undergoing a rotation cycle.
Figure 15B:
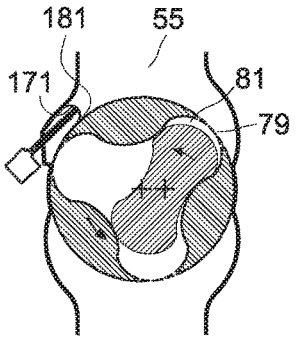
Figure 15C:
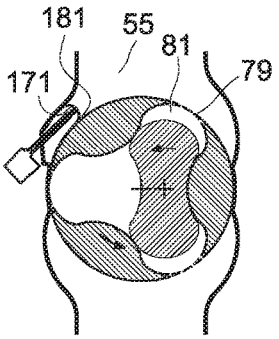
Figure 15D:
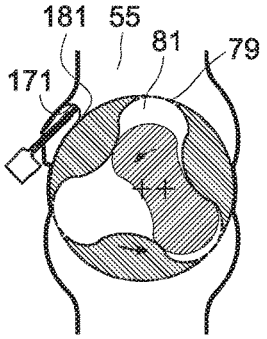
Figure 15E:
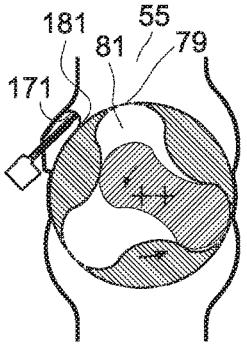
Figure 15F:
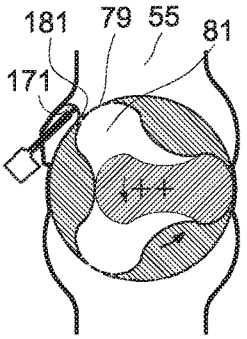
Figure 15G:
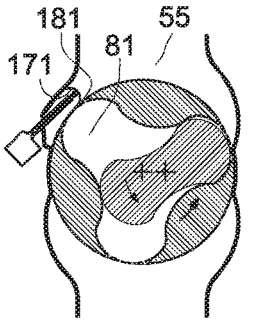
Figure 15H:
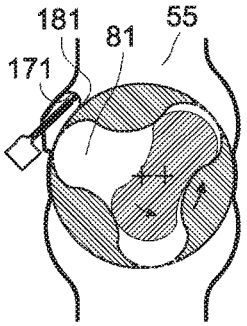
Figure 15I:
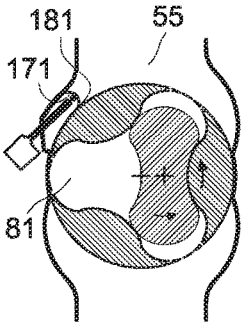
Figure 15J:
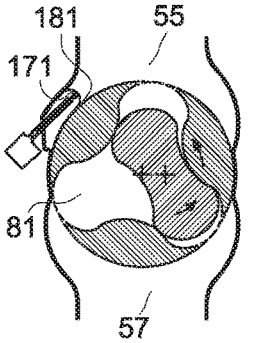
Figure 15K:
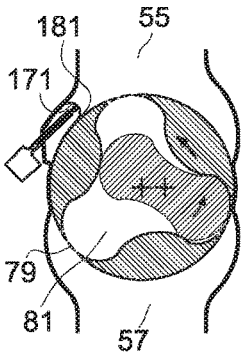
Figure 15L:
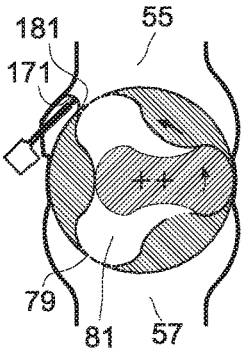

The rotation cycle depicted will now be described with reference to zone 81 as it progressively expands from a minimum volume condition to a maximum volume condition and then begins to exhaust. In FIG. 15*a*, zone 81 has advanced beyond its minimum volume condition and is commencing to expand as its respective port 79 moves into registration with the inlet 55. The zone 81 continues to expand as the expansion rotor assembly 71 continues its rotation cycle, with the port 79 maintaining registration with the inlet 55, as depicted in FIGS. 15*b* to 15*f*. As the zone 81 continues to expand during this phase, air is drawn or inhaled into the expanding zone 81. Ultimately, the port 79 approaches the trailing edge 181 of the inlet 55 defined by cut-off element 171, as depicted in FIG. 15*f*. As the port 79 sweeps past the trailing edge 181 of the inlet 55, it commences to close, as depicted in FIG. 15*g*. Once past the trailing edge 181 of the inlet 55, the port 79 is closed and no longer in registration with the inlet 55, as depicted in FIGS. 15*h* and 15*i*. At this stage the zone 81 is effectively sealed. The zone 81 continues to expand as the rotor assembly 71 continues its rotation cycle and reaches maximum volume in 15*i*. The expansion of the zone 81 causes a reduction in the air pressure; more particularly, the air contained within the zone 81 expands adiabatically. The adiabatic expansion occurs because of the rapid increase in the volume of zone 81 owing to the speed of rotation of the expansion rotor assembly 71, thereby rapidly increasing the volume of air confined within the zone, with little time for heat to flow from or to boundary surfaces defined by the inner rotor 73 and outer rotor 75. As the rotor assembly 71 continues its rotation cycle, immediately after the point of maximum volume, the port 79 moves into registration with the outlet 57 as depicted in FIGS. 15*j* to 15*l*, and the expanded air within the zone 81 exhausts through outlet 57.

It is notable that at various stages during the rotation cycle, two of the ports 79 may be in registration with the inlet 55 at the same time and two ports may be in registration with the outlet 57 at the same time.

The operation of the rotary machine 41 will now be described with reference to FIGS. 16*a* to 16*l* which depict the operation of compressor 27. The compression rotor assembly 72 of the compressor 27 is shown at various stages of its cycle of rotation, with the outer rotor 75*b* being shown at 20-degree increments of rotation. The inter-lobe zones 81, 82 and 83 (each of which constitutes an individual compression chamber 87) are at various stages of expansion and contraction within the rotation cycle of the rotor assembly 71. Progress of the inter-lobe zone 81 is tracked.

Figure 16A:
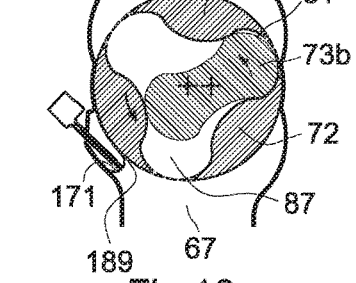
FIG. 16 is a series of sequential views illustrating the compression side of the rotary machine and depicting in particular the compression rotor assembly undergoing a rotation cycle.
Figure 16B:
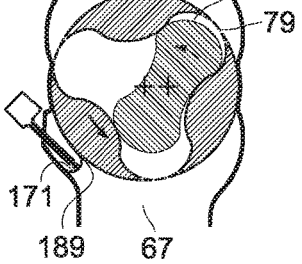
Figure 16C:
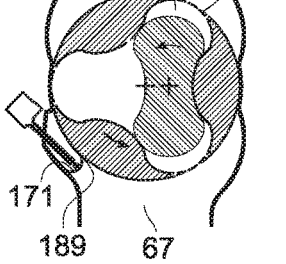
Figure 16D:
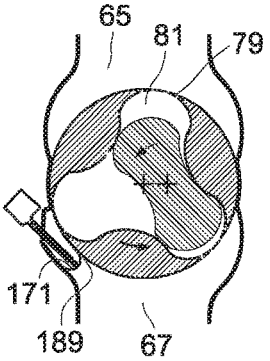
Figure 16E:
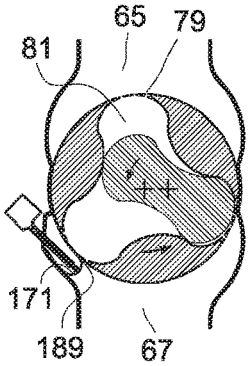
Figure 16F:
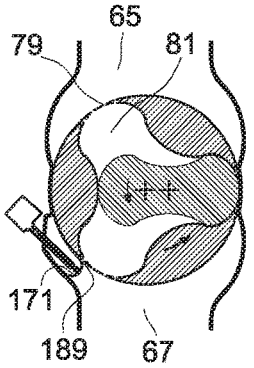
Figure 16G:
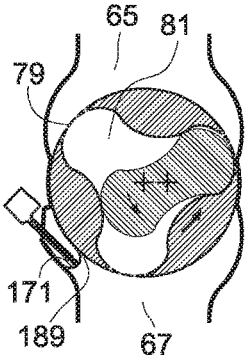
Figure 16H:
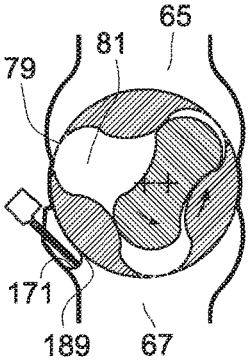
Figure 16I:
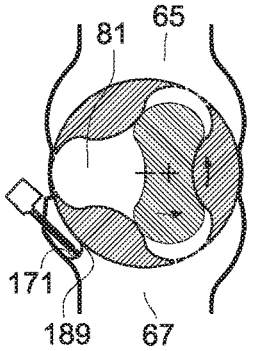
Figure 16J:
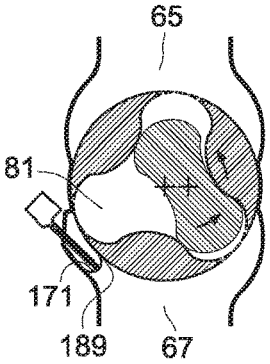
Figure 16K:
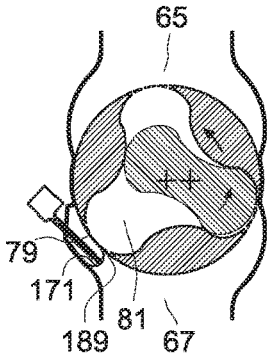
Figure 16L:
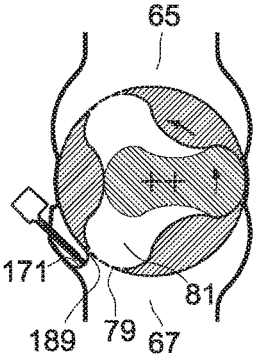

The rotation cycle depicted will now be described with reference to zone 81 as it progressively expands from a minimum volume condition to a maximum volume condition and then begins to exhaust. In FIG. 16*a*, zone 81 has advanced beyond its minimum volume condition and is commencing to expand as its respective port 79 moves into registration with the inlet 65. The zone 81 continues to expand as the expansion rotor assembly 72 continues its rotation cycle, with the port 79 maintaining registration with the inlet 65, as depicted in FIGS. 16*b* to 16*h*. As the zone 81 continues to expand during this phase, air is drawn or inhaled into the expanding zone 81 until it reaches maximum volume, as depicted in FIG. 16*i*, which is also the point at which port 79 moves out of registration with inlet 65. The volume of zone 81 begins to reduce, thereby compressing the air adiabatically. The adiabatic compression occurs because of the rapid decrease in the volume of zone 81 owing to the speed of rotation of the expansion rotor assembly 71, thereby rapidly decreasing the volume of air confined within the zone, with little time for heat to flow from or to boundary surfaces defined by the inner rotor 73 and outer rotor 75. The compression continues until the zone 81 reaches the leading edge 189 of outlet 67, depicted in FIG. 16*k*. As rotation continues the volume of zone 81 continues to reduce, while port 79 maintains registration with outlet 67 and exhaustion is completed at the point where port 79 ends registration with outlet 67.

It is notable that at various stages during the rotation cycle, two of the ports 79 may be in registration with the inlet 65 at the same time and two ports may be in registration with the outlet 67 at the same time.

The degree of expansion and compression can be regulated by the size of the inlet 55 and outlet 67, as determined by the position of the trailing edge 181 or leading edge 189 respectively. In particular, the percentage of expansion or compression of inhaled air can be adjusted by positioning of the trailing edge 181 or leading edge 189, which is an important capability in maximising the efficiency of the system. As previously discussed, the position of the trailing edge 181 and leading edge 189 is determined and can be adjusted by the respective cut-off mechanism 171. It is notable that the ability to regulate the degree of expansion or compression in the air conditioning system 10 through variation of the size of the inlet 55 or outlet 67 provides several ways of enhancing efficiency of the system. Firstly, regulating the degree of expansion, in concert with the ability to regulate the relative volume of the expansion and compression chambers 85, 87, provides a means of maximising the COP in varying environmental conditions and user preferences. Secondly, when high performance is not required, such as when target temperature has been reached, the size of inlet 55 or outlet 67 can be adjusted to minimise the performance of the air conditioning system 10, thus reducing the power required for operation. This avoids the need for the use of an inverter in electrically driven machines and therefore the inherent inefficiencies of inverters.

While the rotation cycle of rotor assembly 71 has been described with reference to zone 81, it will be understood that the other two zones 82, 83 operate in a similar way, each inhaling and expanding air during its expansion phase.

It will be understood that the compression rotor assembly 72 within the compressor 27 operates in a similar manner, but with zones 81, 82 and 83 receiving air during their contraction phase and thereby causing the air to be compressed.

Varying environments and user preferences may be achieved using three variables; specifically, the size of the inlet 55 (i.e. the inlet cut-off as determined by the relative position of the trailing edge 181), the size of the outlet 67 (i.e. the outlet cut-off as determined by the relative position of the leading edge 189), and the variable ratio of expansion and compression chambers 85, 87. Variation of the size of the inlet 55 (i.e. the inlet cut-off as determined by the relative position of the trailing edge 181) and the size of the outlet 67 (i.e. the outlet cut-off as determined by the relative position of the leading edge 189) effectively varies the degree of expansion and compression.

Desirably, the three variables are varied in concert with each other to optimise efficiency of the air conditioning system 10 for varying conditions and user preferences.

With reference to the heating cycle, for example, there are two independent variables, the inlet temperature and the setting the user makes in choosing the manner in which the air-conditioning system 10 is to operate (i.e. how hard the rotary machine 41 is to be worked). The user choice is in the range from high heat production and relatively low coefficient of performance (COP) at one end of the scale and lower heat production with a high COP at the other end. This choice by the user basically sets the position of the inlet cut off, which the microprocessor determines, taking into account the inlet temperature and the user preference. Once those two variables are established, the other two variables (i.e. the release position of the compression side as determined by the position of the outlet cut off and the relative volumes of the expansion and compression chambers) are then calculated by the microprocessor to ensure that air ejected from the compression chamber 87 is at or slightly above atmospheric pressure. These two variables can be considered to be dependent variables.

From the foregoing, it is evident that the present embodiment may provide an air conditioning system that is more energy efficient than currently employed systems and may incorporate provision for the introduction of fresh air without significant cost.

It is a particular feature of the embodiment that the expander 23 and the compressor 27 are drivingly interconnected, whereby mechanical energy can be transferred between the two rotor assemblies 71, 72 without any loss due to mechanical friction. With this arrangement, energy can be salvaged from the expansion of the compression phase and used to assist in the compression of a new intake of air (in the cooling phase), without any loss of energy due to mechanical friction.

Further, the expander 23 and the compressor 27 preferably each comprise a rotor assembly having an externally-lobed rotor and a counterpart outer internally-lobed rotor, with inter-lobe zones providing expansion and compression chambers for air used as the working medium in the air-conditioning system.

Further, the embodiment provides an air conditioning system that has the capability to introduce fresh air into the system for no significant energy cost.

Additionally, the embodiment provides an air conditioning system which is able to reduce electrical power consumption during periods requiring low performance without the need for an inverter, as previously discussed.

While the embodiment described and illustrated relates to an air-conditioning system, it is to be appreciated that the invention is not limited to that application and that it may be used in other applications requiring heating and/or cooling of a gaseous fluid. As alluded to previously, the invention may be applicable as an air-cycle system configured for heating ambient air or an air-cycle system configured for cooling ambient air. Further, the invention may find application in industrial and chemical processing fields as a gas-cycle system configured for heating a gas or a gas-cycle system configured for cooling a gas.

The foregoing disclosure is intended to explain how to fashion and use the particular embodiment described, rather than to limit the true, intended, and fair scope and spirit of the present disclosure. The foregoing description is not intended to be exhaustive, nor to be limited to the precise forms disclosed.

It should be appreciated that various modifications can be made without departing from the principles described herein. Therefore, the principles should be understood to include all such modifications within its scope.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings) may be combined in any combination, except combinations where at least some of such features are mutually exclusive. The invention is not restricted to the details of any foregoing embodiments. The invention extends to any novel one, or any novel combination, of the features disclosed in this specification (including any accompanying claims, abstract and drawings).

The method steps, processes, and operations described herein are not to be construed as necessarily requiring their performance in the particular order discussed or illustrated, unless specifically identified as an order of performance. It is also to be understood that additional or alternative steps may be employed.

The terminology used herein is for the purpose of describing particular example embodiments only and is not intended to be limiting.

As used herein, the singular forms "a", "an" and "the" may be intended to include the plural forms as well, unless the context clearly indicates otherwise.

Reference to any positional descriptions, such as "top", "bottom" and "side", are to be taken in context of the embodiments described and are not to be taken as limiting the invention to the literal interpretation of the term but rather as would be understood by the skilled addressee.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Additionally, where the terms "system", "device", and "apparatus" are used in the context of the invention, they are to be understood as including reference to any group of functionally related or interacting, interrelated, interdependent or associated components or elements that may be located in proximity to, separate from, integrated with, or discrete from, each other.

Throughout this specification, unless the context requires otherwise, the word "comprise" or variations such as "comprises" or "comprising", will be understood to imply the inclusion of a stated integer or group of integers but not the exclusion of any other integer or group of integers.

Furthermore, throughout the specification and the claims that follow, unless the context requires otherwise, the word "include" or variations such as "includes" or "including", will be understood to imply the inclusion of a stated integer or group of integers but not the exclusion of any other integer or group of integers.

The invention claimed is:

1. A gas-cycle system operable using a Bell-Coleman cycle, the gas-cycle system comprising:

an expander and a compressor, the expander and compressor each comprising a rotor assembly configured to define a zone which changes continuously in volume during a rotation cycle of the rotor assembly, the expander and compressor being drivingly interconnected whereby rotational drive applied to one is transmitted directly to the other, the rotor assembly of each of the expander and the compressor comprises an inner rotor and an outer rotor being a counterpart of the inner rotor; and a boundary surface of the zone being movable to vary a swept volume of the zone defined between the inner rotor and the outer rotor to affect a variation of the volume of the zone, the boundary surface being an outer wall that defines the zone, the outer wall being axially movable towards and away from the zone by an actuator.

2. The gas-cycle system according to claim 1, wherein the inner rotor and the outer rotor being configured to rotate about parallel axes at different rotational speeds, the inner and outer rotors being configured to define the zone which changes continuously in the volume during the rotation cycle of the rotor assembly.

3. The gas-cycle system according to claim 2, wherein the inner and outer rotors define a plurality of the zones which are in circumferentially spaced relation and each of which changes continuously in the volume during the rotation cycle of the rotor assembly.

4. The gas-cycle system according to claim 3, wherein the inner rotor comprises an externally-lobed inner rotor and the counterpart outer rotor comprises an internally-lobed outer rotor, wherein the externally-lobed inner rotor is rotatable inside the internally-lobed outer rotor.

5. The gas-cycle system according to claim 4, wherein the outer rotor of the rotor assembly of each of the expander and the compressor comprises at least one port for communicating with the zone defined within the rotor assembly, respectively.

6. The gas-cycle system according to claim 5, wherein both the inner and outer rotors of the expander are drivingly connected to their counterparts in the compressor.

7. The gas-cycle system according to claim 6, wherein the rotor assembly of each of the expander and the compressor is accommodated within a housing having an inlet and an outlet, and wherein the port of the outer rotor, respectively, move sequentially into and out of registration with the inlet and the outlet upon rotation of the rotor assembly within the housing.

8. The gas-cycle system according to claim 7, wherein the expander further comprises means for selectively varying a timing of registration of the port in the outer rotor thereof with the inlet or the outlet of the expander.

9. The gas-cycle system according to claim 8, wherein the expander further comprises means for selectively varying the timing of registration of the port in the outer rotor thereof with the inlet or the outlet of the expander thereby providing means to vary the mass of gas ingested in each cycle.

10. The gas-cycle system according to claim 9, wherein the compressor further comprises means for selectively varying the timing of registration of the port in the outer rotor thereof with the outlet or the inlet of the compressor, thereby providing means to vary the mass of the gas ingested in each cycle.

11. The gas-cycle system according to claim 10, wherein the effective swept volume of the compressor is variable by allowing a cut-off point of the inlet to the compressor to be adjusted beyond bottom dead centre of the outer rotor, thereby exhausting some inlet gas before a beginning of compression.

12. The gas-cycle system according to claim 11 further comprising a microprocessor configured or configurable to determine an optimum combination of values for mass of gas per cycle and ratio of volume of compression and expansion zones, and to apply the values to optimize an operation of the system.

13. The gas-cycle system according to claim 10 further comprising a microprocessor configured or configurable to determine an optimum combination of values for mass of gas per cycle and ratio of volume of compression and expansion zones, and to apply the values to optimize an operation of the system.

14. The gas-cycle system according to claim 10, wherein the gas-cycle system is operably configured to reduce pressure and temperature of the gas, to pass the gas through a heat exchanger and warmed without changing the pressure, to compress the gas adiabatically to ambient pressure to increase the temperature, and then to discharge the gas.

15. The gas-cycle system according to claim 10, wherein the gas-cycle system is operably configured to cool incoming gas by compressing adiabatically to increase pressure and temperature, to pass the incoming gas through a heat exchanger to reduce the temperature, to expand the incoming gas adiabatically to reduce the temperature, and then to discharge the incoming gas.

16. An air-conditioning system comprising and air-cycle system comprising the gas-cycle system according to claim 13.

17. An air-conditioning system comprising and air-cycle system comprising the gas-cycle system according to claim 12.

* * * * *